US010872545B2

(12) United States Patent
Wang et al.

(10) Patent No.: US 10,872,545 B2
(45) Date of Patent: Dec. 22, 2020

(54) DETECTION METHOD AND APPARATUS FOR DISPLAY PANEL, DETECTION DEVICE AND STORAGE MEDIUM

(71) Applicants: Hefei Xinsheng Optoelectronics Technology Co., Ltd., Anhui (CN); BOE Technology Group Co., Ltd., Beijing (CN)

(72) Inventors: Tao Wang, Beijing (CN); Zhidong Yuan, Beijing (CN); Sheng Zhu, Beijing (CN); Zhengyuan Zhang, Beijing (CN); Peng Sui, Beijing (CN); Jun Zhang, Beijing (CN); Qiao Zhu, Beijing (CN)

(73) Assignees: HEFEI XINSHENG OPTOELECTRONICS TECHNOLOGY CO., LTD, Hefei (CN); BOE TECHNOLOGY GROUP CO., LTD., Beijng (CN)

( * ) Notice: Subject to any disclaimer, the term of this patent is extended or adjusted under 35 U.S.C. 154(b) by 0 days.

(21) Appl. No.: 16/335,866

(22) PCT Filed: Aug. 7, 2018

(86) PCT No.: PCT/CN2018/099198
§ 371 (c)(1),
(2) Date: Mar. 22, 2019

(87) PCT Pub. No.: WO2019/029532
PCT Pub. Date: Feb. 14, 2019

(65) Prior Publication Data

US 2019/0259317 A1 Aug. 22, 2019

(30) Foreign Application Priority Data

Aug. 8, 2017 (CN) ..... 2017 1 0672710

(51) Int. Cl.
*G09G 3/00* (2006.01)
*G09G 3/3225* (2016.01)
(Continued)

(52) U.S. Cl.
CPC ..... *G09G 3/006* (2013.01); *G09G 3/00* (2013.01); *G09G 3/20* (2013.01); *G09G 3/32* (2013.01);
(Continued)

(58) Field of Classification Search
CPC .. G09G 3/00; G09G 3/20; G09G 3/32; G09G 3/3225; G09G 3/006; G09G 2330/12
See application file for complete search history.

(56) References Cited

U.S. PATENT DOCUMENTS 9,361,820 B2 * 6/2016 Lee ..... G09G 3/006
9,778,777 B2 * 10/2017 Yeh ..... G01R 27/267

FOREIGN PATENT DOCUMENTS

CN 103426383 A 12/2013
CN 104280661 A 1/2015
KR 20060038081 A 5/2006

OTHER PUBLICATIONS

International Search Report (including English translation) and Written Opinion of PCT/CN2018/099198, dated Sep. 30, 2018.

* cited by examiner

*Primary Examiner* — Kenneth B Lee, Jr.
(74) *Attorney, Agent, or Firm* — Fay Sharpe LLP

(57) ABSTRACT

Provided are a detection method and apparatus for a display panel, a detection device and a storage medium. The method includes: providing a second data signal to a data input end, providing a second gate line scan signal to a gate electrode scan input end, and providing a power source signal to a power source end, wherein during an inputting process, the second data signal is at a first level, a level of the second gate
(Continued)

line scan signal jumps from the first level to a second level, a level of the power source signal jumps from the first level to the second level, and the level of the second gate line scan signal jumps before the jumping of the level of the power source signal; acquiring a second voltage of each pixel electrode; and determining a faulty gate line according to the second voltage.

20 Claims, 17 Drawing Sheets

(51) Int. Cl.
*G09G 3/20* (2006.01)
*G09G 3/32* (2016.01)

(52) U.S. Cl.
CPC ..... *G09G 3/3225* (2013.01); *G09G 2330/12* (2013.01)

DETECTION METHOD AND APPARATUS FOR DISPLAY PANEL, DETECTION DEVICE AND STORAGE MEDIUM

CROSS-REFERENCE TO RELATED APPLICATION

This application is a 371 of PCT Patent Application Serial No. PCT/CN2018/099198, filed on Aug. 7, 2018, which claims priority to Chinese Patent Application No. 201710672710.2, filed on Aug. 8, 2017 and entitled "DETECTION METHOD AND APPARATUS FOR DISPLAY PANEL", the entire contents of which are incorporated herein by reference.

TECHNICAL FIELD

The present disclosure relates to the field of display technology, and more particularly to a detection method and apparatus for display panel, a detection device and a storage medium.

BACKGROUND

With the development of display technologies, various products having display functions appear in daily life, such as mobile phones, tablet computers, televisions, notebook computers, digital photo frames and navigators, each of which requires to be assembled with a display panel.

Currently, an active-matrix organic light emitting diode (AMOLED) display panel as a new display panel on the market may comprise a plurality of data lines and a plurality of gate lines. Each two adjacent data lines and each two adjacent gate lines form a pixel unit in an enclosing manner. Each pixel unit corresponds to a driving circuit which is used for driving a corresponding pixel unit to emit light.

SUMMARY

The present disclosure provides a detection method and apparatus for display panel, a detection device and a storage medium. The technical solutions are as follows.

According to an aspect, there is provided a detection method for a display panel, wherein the display panel comprises a plurality of data lines, a plurality of gate lines, and a plurality of pixel units enclosed by the plurality of data lines and the plurality of gate lines in an intersected manner; at least a part of the pixel units comprises a driving circuit and a pixel electrode that are connected with each other; the driving circuit is further connected to a data input end, a gate electrode scan input end and a power source end, respectively; and the method comprises: providing a second data signal to the data input end, providing a second gate line scan signal to the gate electrode scan input end, and providing a power source signal to the power source end, wherein during a signal inputting process, the second data signal is at a first level, a level of the second gate line scan signal jumps from the first level to a second level, a level of the power source signal jumps from the first level to the second level, and the level of the second gate line scan signal jumps before the jumping of the level of the power source signal; acquiring a second voltage of each pixel electrode; and determining a faulty gate line according to the second voltage.

Optionally, determining the faulty gate line according to the second voltage comprises: judging whether the second voltage of each pixel electrode is within a second reference voltage range; and determining that the gate line which transmits the second gate line scan signal to a second target pixel unit is faulty, wherein the second target pixel unit is a pixel unit in which the second voltage of the pixel electrode is within the second reference voltage range; wherein a lower limit value in the second reference voltage range is greater than or equal to a voltage value when the power source signal is at the second level.

Optionally, after acquiring the second voltage of each pixel electrode, the method further comprises: judging whether the second voltage of the pixel electrode is within a fourth reference voltage range; and determining that the gate line which transmits the second gate line scan signal to a fourth target pixel unit is not faulty, wherein the fourth target pixel unit is a pixel unit in which the second voltage of the pixel electrode is within the fourth reference voltage range; wherein a lower limit value in the fourth reference voltage range is greater than an upper limit value in the second reference voltage range.

Optionally, the method further comprises: determining a faulty data line; and determining a position of a defective point in the display panel according to the faulty gate line and the faulty data line.

Optionally, determining the faulty data line comprises: providing a first data signal to the data input end, providing a first gate line scan signal to the gate electrode scan input end, and providing a power source signal to the power source end, wherein during the signal inputting process, the first gate line scan signal is at the first level, a level of the first data signal jumps from the first level to the second level, a level of the power source signal jumps from the first level to the second level, and the level of the first data signal jumps before the jumping of the level of the power source signal; acquiring a first voltage of each pixel electrode; and determining the faulty data line according to the first voltage.

Optionally, determining the faulty data line according to the first voltage comprises: judging whether the first voltage of each pixel electrode is within a first reference voltage range; and determining that the data line which transmits the first data signal to a first target pixel unit is faulty, wherein the first target pixel unit is a pixel unit in which the first voltage of the pixel electrode is within the first reference voltage range; wherein a lower limit value in the first reference voltage range is greater than or equal to a voltage value when the power source signal is at the second level.

Optionally, after acquiring the first voltage of each pixel electrode, the method further comprises: judging whether the first voltage of each pixel electrode is within a third reference voltage range; and determining that the data line which transmits the first data line to a third target pixel unit is not faulty, wherein the third target pixel unit is a pixel unit in which the first voltage of the pixel electrode is within the third reference voltage range, wherein a lower limit value in the third reference voltage range is greater than an upper limit value in the first reference voltage range.

Optionally, an occurrence of the defective point in the display panel refers to the gate line and the data line in the display panel are short-circuited.

Optionally, when the first gate line scan signal is at the first level, the voltage value is 20 volts; when the first data signal is at the first level, the voltage value is 25 volts; when the first data signal is at the second level, the voltage value is −8 volts; when the power source signal is at the first level, the voltage value is 25 volts; and when the power source signal is at the second level, the voltage value is −15 volts; and when the second data signal is at the first level, the voltage value is 8 volts; when the second gate line scan signal is at the first level, the voltage value is 25 volts; and when the second gate line scan signal is at the second level, the voltage value is −25 volts.

According another aspect, there is provided a detection method for a display panel, wherein the display panel comprises a plurality of data lines, a plurality of gate lines, and a plurality of pixel units enclosed by the plurality of data lines and the plurality of gate lines in an intersected manner; at least a part of the pixel units comprises a driving circuit and a pixel electrode that are connected with each other; the driving circuit is further connected to a data input end, a gate electrode scan input end and a power source end, respectively; and the method comprises: providing a first data signal to the data input end, providing a first gate line scan signal to the gate electrode scan input end, and providing a power source signal to the power source end, wherein during a signal inputting process, the first gate line scan signal is at a first level, a level of the first data signal jumps from the first level to a second level, a level of the power source signal jumps from the first level to the second level, and the level of the first data signal jumps before the jumping of the level of the power source signal; acquiring a first voltage of each pixel electrode; and determining a faulty data line according to the first voltage.

Optionally, determining the faulty data line according to the first voltage comprises: judging whether the first voltage of each pixel electrode is within a first reference voltage range; and determining that the data line which transmits the first data signal to a first target pixel unit is faulty, wherein the first target pixel unit is a pixel unit in which the first voltage of the pixel electrode is within the first reference voltage range; wherein a lower limit value in the first reference voltage range is greater than or equal to a voltage value when the power source signal is at the second level.

Optionally, after acquiring the first voltage of each pixel electrode, the method further comprises: judging whether the first voltage of each pixel electrode is within a third reference voltage range; and determining that the data line which transmits the first data signal to a third target pixel unit is not faulty, wherein the third target pixel unit is a pixel unit in which the first voltage of the pixel electrode is within the third reference voltage range; wherein a lower limit value in the third reference voltage range is greater than an upper limit value in the first reference voltage range.

Optionally, the method further comprises: determining a faulty data line; and determining a position of a defective point in the display panel according to the faulty gate line and the faulty data line.

According to yet another aspect, there is provided a detection apparatus for a display panel, wherein the display panel comprises a plurality of data lines, a plurality of gate lines, and a plurality of pixel units enclosed by the plurality of data lines and the plurality of gate lines in an intersected manner; at least a part of the pixel units comprises a driving circuit and a pixel electrode that are connected with each other; the driving circuit is connected to a data input end, a gate electrode scan input end and a power source end, respectively; and the apparatus comprises: a second input module configured to provide a second data signal to the data input end, provide a second gate line scan signal to the gate electrode scan input end, and provide a power source signal to the power source end, wherein during a signal inputting process, the second data signal is at a first level, a level of the second gate line scan signal jumps from the first level to a second level, a level of the power source signal jumps from the first level to the second level, and the level of the second gate line scan signal jumps before the jumping of the level of the power source signal; a second acquirement module configured to acquire a second voltage of each pixel electrode; and a second determination module configured to determine a faulty gate line according to the second voltage.

Optionally, the second determination module is configured to: judge whether the second voltage of each pixel electrode is within a second reference voltage range; and determine that the gate line which transmits the second gate line scan signal to a second target pixel unit is faulty, wherein the second target pixel unit is a pixel unit in which the second voltage of the pixel electrode is within the second reference voltage range; wherein a lower limit value in the second reference voltage range is greater than or equal to a voltage value when the power source signal is at the second level.

Optionally, the apparatus further comprises: a second judgement module configured to judge whether the second voltage of each pixel electrode is within a fourth reference voltage range; and a fifth determination module configured to determine that the gate line which transmits the second gate line scan signal to a fourth target pixel unit is not faulty, wherein the fourth target pixel unit is a pixel unit in which the second voltage of the pixel electrode is within the fourth reference voltage range; wherein a lower limit value in the fourth reference voltage range is greater than an upper limit value in the second reference voltage range.

Optionally, the apparatus further comprises: a first determination module configured to determine a faulty data line; and a third determination module configured to determine a position of a defective point in the display panel according to the faulty gate line and the faulty data line.

Optionally, the apparatus further comprises: a first input module configured to provide a first data signal to the data input end, provide a first gate line scan signal to the gate electrode scan input end, and provide a power source signal to the power source end, wherein during a signal inputting process, the first gate line scan signal is at the first level, a level of the first data signal jumps from the first level to the second level, a level of the power source signal jumps from the first level to the second level, and the level of the first data signal jumps before the jumping of the level of the power source signal, a first acquirement module configured to acquire a first voltage of each pixel electrode; and a first determination module configured to determine a faulty data line according to the first voltage.

Optionally, the first determination module is configured to: judge whether the first voltage of each pixel electrode is within a first reference voltage range, and determine that the data line which transmits the first data signal to a first target pixel unit is faulty, wherein the first target pixel unit is a pixel unit in which the first voltage of the pixel electrode is within the first reference voltage range, wherein a lower limit value in the first reference voltage range is greater than or equal to a voltage value when the power source signal is at the second level.

Optionally, the apparatus further comprises: a first judgment module configured to judge whether the first voltage of each pixel electrode is within a third reference voltage range; and a fourth determination module configured to determine that the data line which transmits the first data line to a third target pixel unit is not faulty, wherein the third target pixel unit is a pixel unit in which the first voltage of the pixel electrode is within the third reference voltage range, wherein a lower limit value in the third reference voltage range is greater than an upper limit value in the first reference voltage range.

Optionally, an occurrence of the defective point in the display panel refers to that the gate line and the data line in the display panel are short-circuited.

Optionally, when the first gate line scan signal is at the first level, the voltage value is 20 volts; when the first data signal is at the first level, the voltage value is 25 volts; when the first data signal is at the second level, the voltage value is −8 volts; when the power source signal is at the first level, the voltage value is 25 volts; when the power source signal is at the second level, the voltage value is −15 volts; and when the second data signal is at the first level, the voltage value is 8 volts; when the second gate line scan signal is at the first level, the voltage value is 25 volts; and when the second gate line scan signal is at the second level, the voltage value is −25 volts.

According to still yet another aspect, there is provided a detection apparatus for a display panel, wherein the display panel comprises a plurality of data lines, a plurality of gate lines, and a plurality of pixel units enclosed by the plurality of data lines and the plurality of gate lines in an intersected manner; at least a part of the pixel units comprises a driving circuit and a pixel electrode that are connected with each other; the driving circuit is further connected to a data input end, a gate electrode scan input end and a power source end, respectively; and the apparatus comprises: a first input module configured to provide a first data signal to the data input end, provide a first gate line scan signal to the gate electrode scan input end, and provide a power source signal to the power source end, wherein during a signal inputting process, the first gate line scan signal is at a first level, a level of the first data signal jumps from the first level to a second level, a level of the power source signal jumps from the first level to the second level, and the level of the first data signal jumps before the jumping of the level of the power source signal; a first acquirement module configured to acquire a first voltage of each pixel electrode; and a first determination module configured to determine a faulty data line according to the first voltage.

Optionally, the first determination module is configured to: judge whether the first voltage of each pixel electrode is within a first reference voltage range; and determine that the data line which transmits the first data signal to a first target pixel unit is faulty, wherein the first target pixel unit is a pixel unit in which the first voltage of the pixel electrode is within the first reference voltage range; wherein a lower limit value in the first reference voltage range is greater than or equal to a voltage value when the power source signal is at the second level.

Optionally, the apparatus further comprises: a first judgement module configured to judge whether the first voltage of each pixel electrode is within a third reference voltage range; and a fourth determination module configured to determine that the data line which transmits the first data signal to a third target pixel unit is not faulty, wherein the third target pixel unit is a pixel unit in which the first voltage of the pixel electrode is within the third reference voltage range; wherein a lower limit value in the third reference voltage range is greater than an upper limit value in the first reference voltage range.

Optionally, the apparatus further comprises: a second determination module configured to determine a faulty gate line; and a third determination module configured to determine a position of a defective point in the display panel according to the faulty gate line and the faulty data line.

In a third aspect, there is provided a detection device comprising: a processor, and a memory storing at least one program executed by the processor for performing the detection method for the display panel according to any of above aspects. Optionally, the detection device further comprises: a bearing base, a first signal input component and a second signal input component that are connected with the processor; wherein the bear base is configured to bear a display panel; the first signal input component is configured to provide the data signal used for detection to data lines in the display panel under the control of the processor, and the second signal input component is configured to provide the gate electrode scan signal used for detection to gate lines in the display panel under the control of the processor.

Optionally, the first signal input component and the second signal input component are arranged on the bear base.

According to still yet another aspect, there is provided a computer-readable storage medium storing a computer program, wherein the stored computer program is executed by a processor for implementing the detection method for the display panel of any of the above aspects.

BRIEF DESCRIPTION OF THE DRAWINGS

In order to describe the technical solutions in the embodiments of the present more clearly, the following briefly introduces the accompanying drawings required for describing the embodiments. Apparently, the accompanying drawings in the following description show merely some embodiments of the present disclosure, and a person of ordinary skill in the art may also derive other drawings from these accompanying drawings without creative efforts.

DETAILED DESCRIPTION

The embodiments of the present disclosure will be described in further detail with reference to the accompanying drawings, to clearly present the objects, technical solutions, and advantages of the present disclosure.

As known by inventor(s), as forming a plurality of data lines and a plurality of gate lines in an AMOLED display panel is difficult, many undesirable phenomena such as a short circuit and an open circuit may exist in the gate lines and the data lines, resulting in a defect in a produced AMOLED display panel. In order to improve a product yield of the AMOLED display panel, it is required to detect the AMOLED display panel.

However, when detecting an AMOLED display panel in the prior art, the efficiency of detecting the display panel is low. For example, when detecting whether the gate line and the data line are short-circuited, only a defect in the data line can be detected (that is, a faulty data line can be detected), but a defect in the gate line cannot be detected (that is, a faulty gate line cannot be detected), or the accuracy of detecting the defects of data line is low. As a result, the position of the defective point in the AMOLED display panel cannot be accurately located. Since the position of the defective point is the position where the faulty gate line intersects the faulty data line, the faulty gate line and the data line cannot be repaired, so the current AMOLED display panel has a lower product yield.

Figure 1:
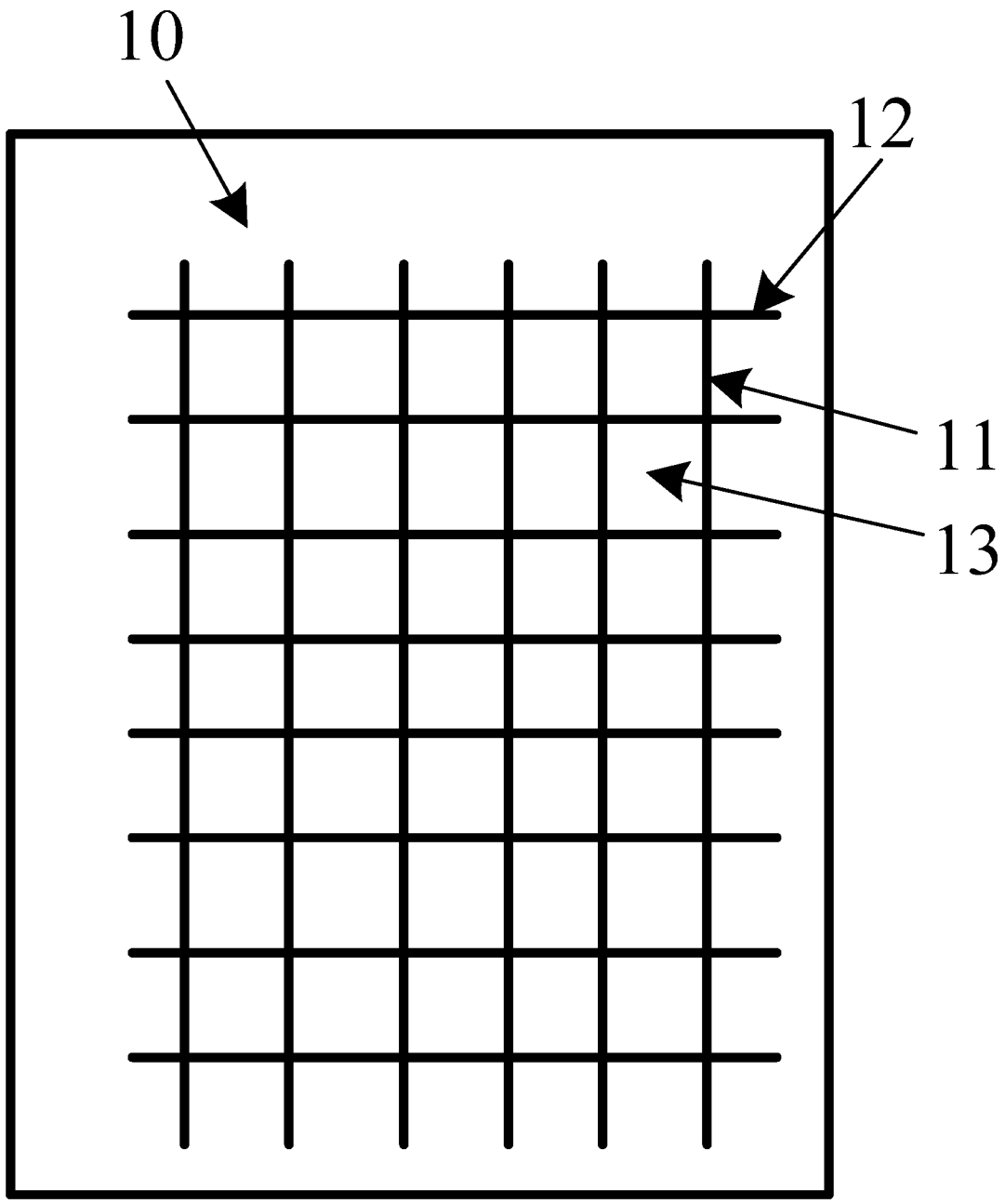
FIG. 1 is a schematic view of a structure of a display panel provided in an embodiment of the present disclosure.

An embodiment of the present disclosure provides a display panel. FIG. 1 is a schematic view of a structure of a display panel provided in an embodiment of the present disclosure. As shown in FIG. 1, the display panel 10 may comprise a plurality of data lines 11, a plurality of gate lines 12, and a plurality of pixel units 13 enclosed by the plurality of data lines 11 and the plurality of gate lines 12 in an intersected manner; at least a part of the pixel units 13 may comprise a driving circuit and a pixel electrode; and the driving circuit is further connected to a data line 11, a gate line 12 and a power source end, respectively. Herein, the driving circuit charges the pixel electrode connected thereto, and the pixel unit in which the pixel electrode is located emits lights based on the charge stored in the pixel electrode.

Figure 2:
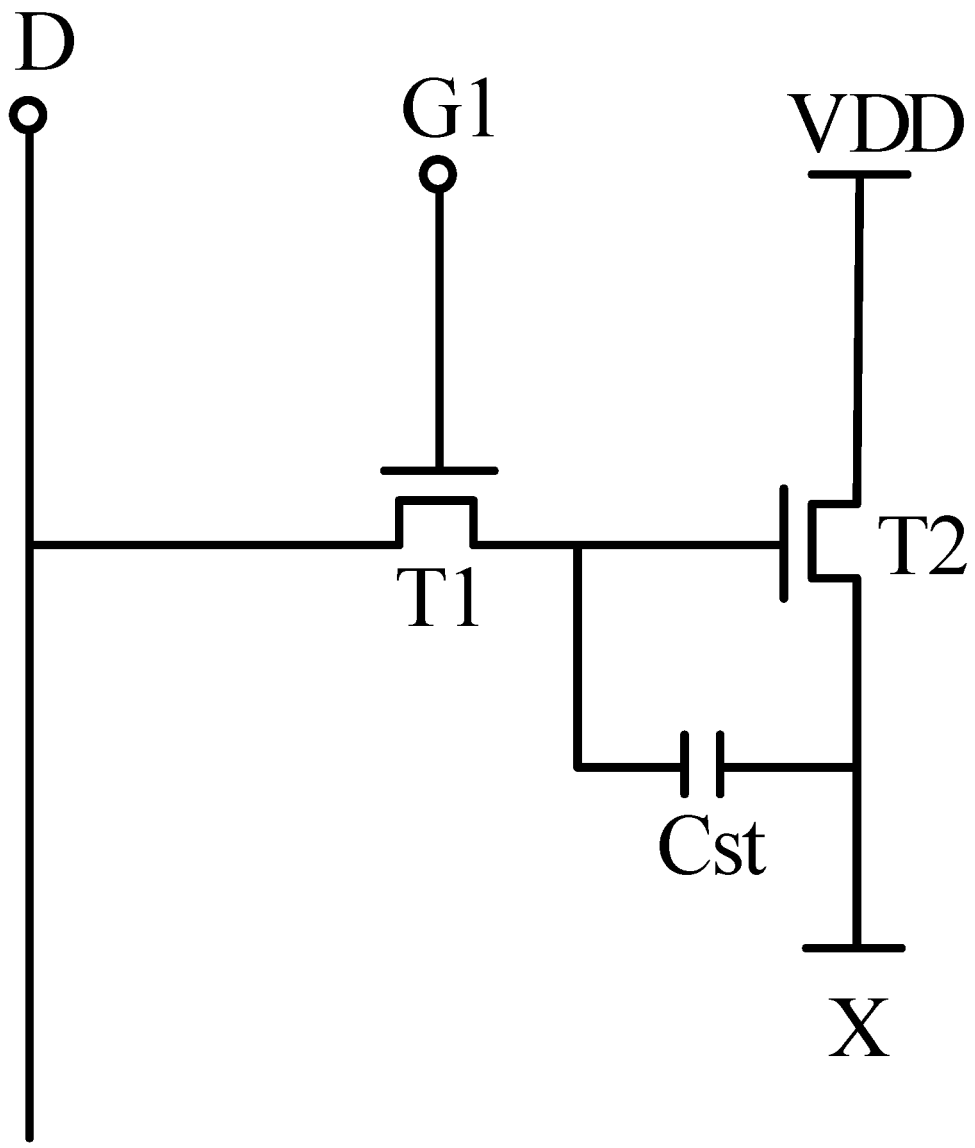
FIG. 2 is a schematic view of a structure of a driving circuit provided in an embodiment of the present disclosure.

For example, FIG. 2 is a schematic view of a structure of a driving circuit provided in an embodiment of the present disclosure. As shown in FIG. 2, the driving circuit may comprise: a first transistor T1, a second transistor T2 and a pixel storage capacitor Cst.

A gate electrode of the first transistor T1 is connected to the gate line; a first electrode of the first transistor T1 is connected to the data line; and a second electrode of the first transistor T1 is connected to a gate electrode of the second transistor T2 and an end of the pixel storage capacitor Cst. Herein, the end of the pixel storage capacitor Cst may be provided with a first metal layer.

A first electrode of the second transistor T2 is connected to a power source end VDD; and a second electrode of the second transistor T2 is connected to another end of the pixel storage capacitor Cst and a pixel electrode X. Herein, the another end of the pixel storage capacitor Cst may be provided with a second metal layer.

In the embodiments of the present disclosure, in order to distinguish two electrodes of the transistor in addition to the gate electrode, a source electrode of the transistor may be referred to as a first electrode, and a drain electrode of the transistor may be referred to as a second electrode. Alternatively, the drain electrode of the transistor may be referred to as the first electrode, and the source electrode in the transistor may be referred to as the second electrode. The following embodiments are schematically illustrated by referring to the source electrode in the transistor as the first electrode and the drain electrode as the second electrode. A switching transistor used in the embodiments of the present disclosure may be an N-type switching transistor or P-type switching transistor. Herein, the N-type switching transistor is turned on when the gate electrode is at a high level, and is turned off when the gate electrode is at a low level. The P-type switching transistor is turned on when the gate electrode is at a low level, and is turned off when the gate electrode is at a high level. Moreover, a plurality of signals in various embodiments of the present disclosure each corresponds to a first level and a second level. The first level and the second level only represent two state quantities of the level of this signal, rather than a specific value of the first level or the second level.

Figure 3:
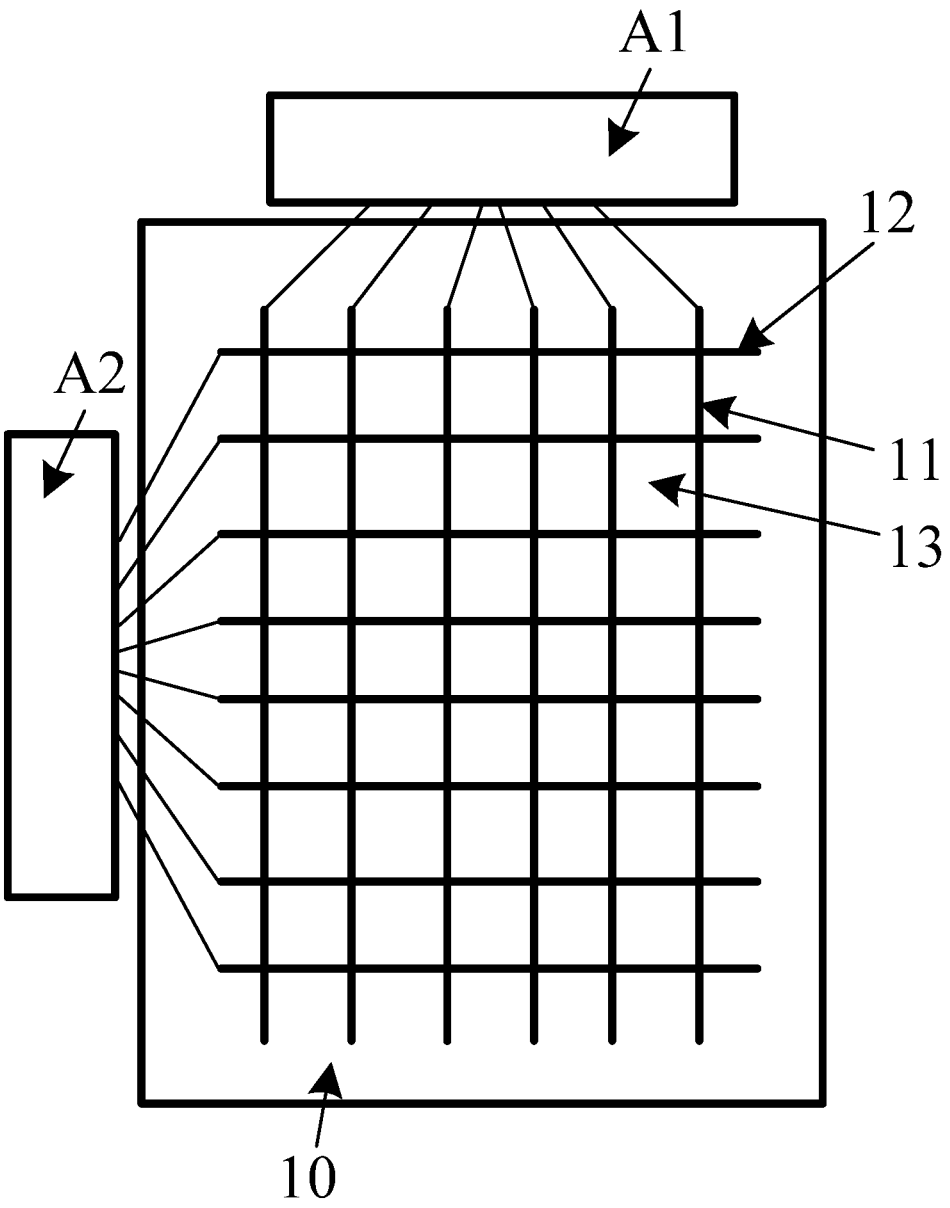
FIG. 3 is a schematic view of an effect of a display panel mounted on a detection device provided in the embodiment of the present disclosure.

In some embodiments, a gate insulating layer is arranged between a source-drain electrode pattern and a gate electrode pattern in the display panel. When manufacturing the display panel, the gate insulating layer may not completely insulate the source-drain electrode pattern and the gate electrode pattern due to a process error or other reasons. As a result, the source-drain electrode pattern is in contact with the gate electrode pattern, causing a short circuit between the gate line and the data line which affects the production yield rate of the display panel. In order to improve the product yield of the display panel, it is required to detect the display panel. When detecting the display panel provided in the embodiments of the present disclosure, it is required to mount the display panel on a detection device. For example, FIG. 3 is a schematic view of an effect of a display panel mounted on a detection device provided in the embodiment of the present disclosure. As shown in FIG. 3, the detection device may comprise a first signal input component A1 and a second signal input component A2. The plurality of data lines 11 in the display panel 10 are connected to the same data input end; and the data input end is connected to the first signal input component A1. During the detection process of the display panel, the plurality of gate lines 12 in the display panel 10 are connected to the same gate electrode scan input end; and the gate electrode scan input end is connected to the second signal input component A2. The first signal input component A1 is configured to simultaneously provide a first data signal to the plurality of data lines through the data input end, or simultaneously provide a second data signal to the plurality of data lines through the data input end. The second signal input component A2 is configured to simultaneously provide a first gate line scan signal to the plurality of gate lines through the gate electrode scan input end, or simultaneously provide a second gate line scan signal to the plurality of gate lines through the gate electrode scan input end. The timing sequences of the first data signal and the second data signal are different, and the timing sequences of the first gate scan signal and the second gate scan signal are different.

Moreover, in a detection process of a display panel provided in the embodiments of the present disclosure, a driving circuit in each pixel unit may be connected to a data input end, a driving circuit and a gate electrode scan input end. The connection manner can be referred to FIG. 2. As shown in FIG. 2, the gate electrode of the first transistor T1 is connected to the gate scan input terminal G1 through a gate line, and a first end of the first transistor T1 is connected to the data input terminal D through a data line.

Figure 4:
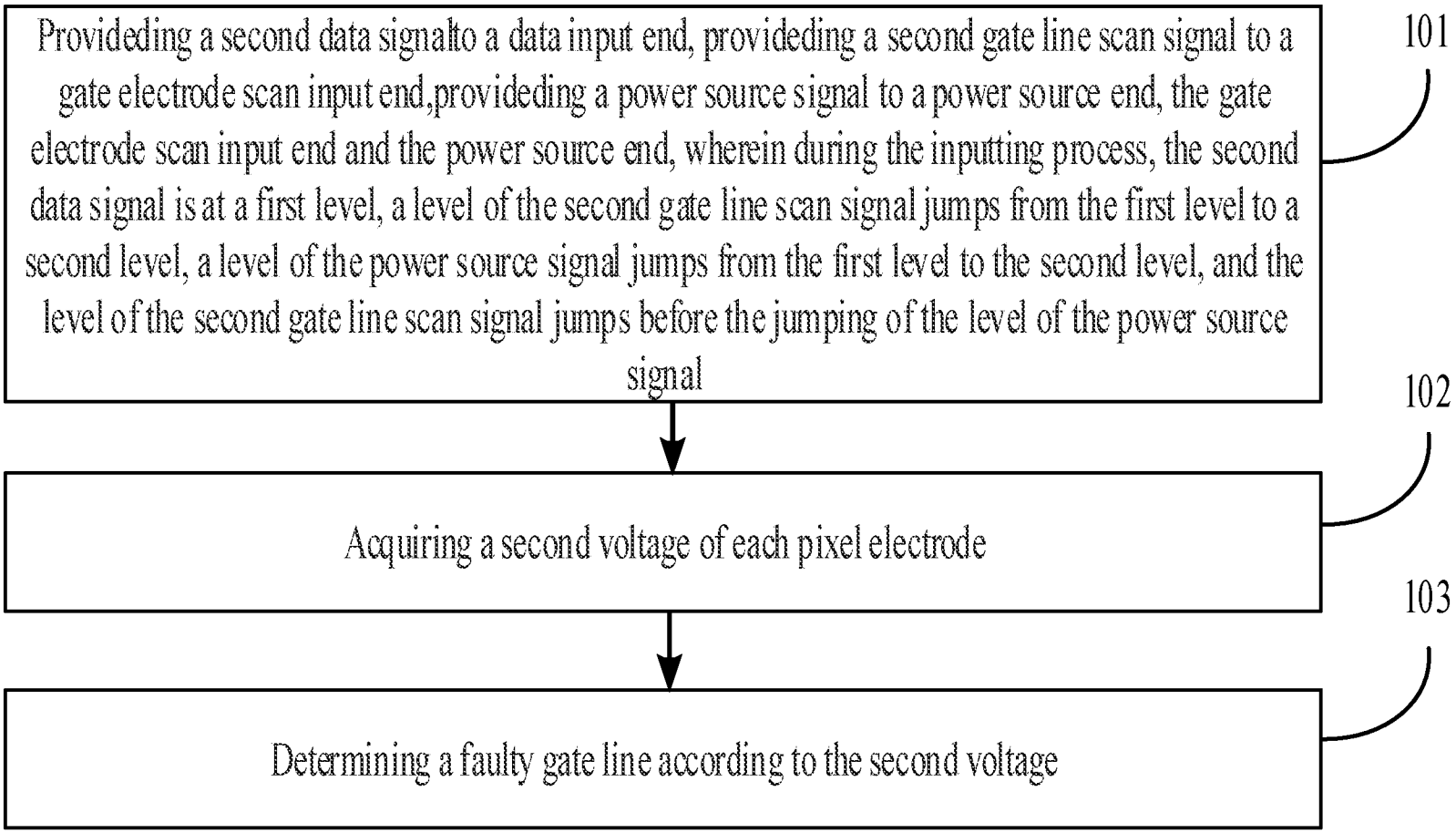
FIG. 4 is a flow chart of a detection method for a display panel provided in an embodiment of the present disclosure.

An embodiment of the present disclosure provides a detection method for a display panel. FIG. 4 is a flow chart of the detection method for the display panel provided in an embodiment of the present disclosure. As shown in FIG. 4, the method is configured to detect the display panel shown in FIG. 1, and determine a faulty gate line in the display panel. The method may comprise the following steps.

In step 101, a second data signal is provided to a data input end, a second gate line scan signal is provided to a gate electrode scan input end, and a power source signal is provided to a power source end. In the signal input process, the second data signal is at a first level; a level of the second gate line scan signal jumps from the first level to a second level; a level of the power source signal jumps from the first level to the second level; and the level of the second gate line scan signal jumps before the jumping of the level of the power source signal.

In step 102, a second voltage of each pixel electrode is acquired.

In step 103, a faulty gate line is determined in accordance with the second voltage.

In summary, in the detection method for the display panel provided in the embodiments of the present disclosure, during a process of providing the second data signal, the second gate line scan signal and the power source signal, the second voltage of each pixel electrode is acquired; and the faulty gate line is determined in accordance with the change of the second voltage during the process. Compared with the related art, the faulty gate line can be detected quickly and effectively, and the efficiency of detecting the display panel can be improved.

In the embodiments of the present disclosure, the method may further comprise: detecting a faulty data line. Correspondingly, a position of a defective point in the display panel can be determined according to a faulty gate line and the faulty data line. Optionally, the defective point is a short-circuited defective point. That is, a defective point in the display panel refers to that the gate line and the data line in the display panel are short-circuited. When the gate line and the data line are short-circuited, the position where the gate line is connected to the data line is the position of the defective point.

Figure 5:
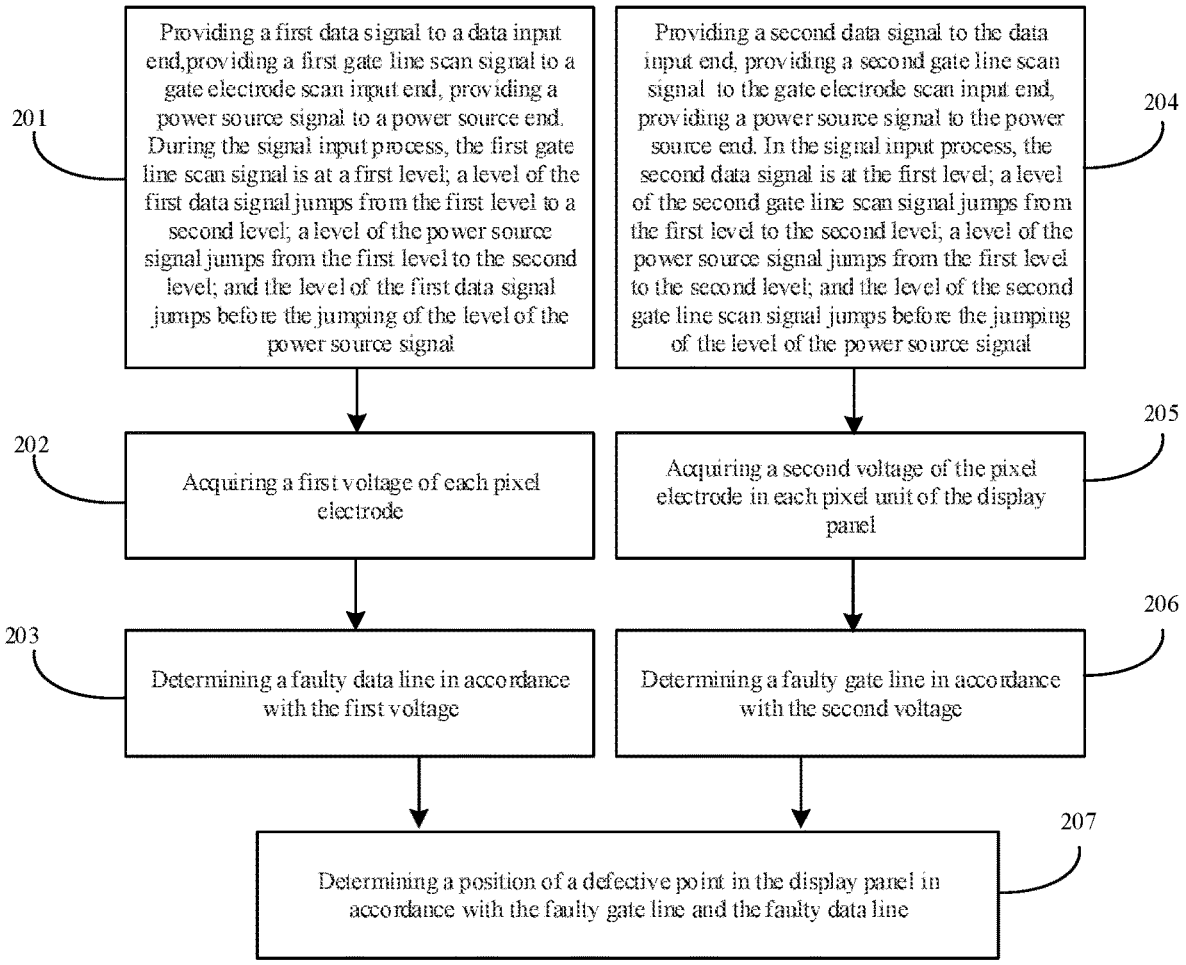
FIG. 5 is a flow chart of a detection method for another display panel provided in an embodiment of the present disclosure.

For example, as shown in FIG. 5, FIG. 5 is a flow chart of a detection method for another display panel provided in an embodiment of the present disclosure. The method is configured to detect the display panel shown in FIG. 1, and determine a short-circuited gate line and a short-circuited data line in the display panel. The method may comprise the following steps.

In step 201, a first data signal is provided to a data input end, a first gate line scan signal is provided to a gate electrode scan input end, and a power source signal is provided to a power source end. In a signal input process, the first gate line scan signal is at a first level; a level of the first data signal jumps from the first level to a second level; a level of the power source signal jumps from the first level to the second level; and the level of the first data signal jumps before the jumping of the level of the power source signal.

In step 202, a first voltage of each pixel electrode is acquired.

In step 203, a faulty data line is determined in accordance with the first voltage.

In step 204, a second data signal is provided to the data input end, a second gate line scan signal is provided to the gate electrode scan input end, and a power source signal is provided to the power source end, respectively. In the signal inputting process, the second data signal is at the first level; a level of the second gate line scan signal jumps from the first level to the second level; a level of the power source signal jumps from the first level to the second level; and the level of the second gate line scan signal jumps before the jumping of the level of the power source signal.

In step 205, a second voltage of each pixel electrode is acquired.

In step 206, a faulty gate line is determined in accordance with the second voltage.

In step 207, a position of a defective point in the display panel is determined in accordance with the faulty gate line and the faulty data line.

In summary, in the detection method for the display panel provided in the embodiments of the present disclosure, during a process of providing the first data signal, the first gate line scan signal and the power source signal, the first voltage of each pixel electrode is acquired; the faulty data line is determined in accordance with the change of first voltage during the process; during a process of providing the second data signal, the second gate line scan signal and the power source signal, the second voltage of each pixel electrode is acquired; and the faulty gate line is determined in accordance with the change of second voltage during the process, thereby detecting the faulty data line and the faulty gate line quickly and effectively. And the position of the defective point in the display panel is determined in accordance with the faulty gate line and the faulty data line, which improves the efficiency of detecting the display panel. Moreover, after the position of the defective point in the display panel is determined, the gate line and the data line that correspond to the defective point can be repaired, so that the product yield of the display panel can be improved.

In the embodiments of the present disclosure, different signals are provided to the plurality of data lines through the first signal input component, and different signals are provided to the plurality of gate lines through the second signal input component, so that the faulty data line and the faulty gate line can be determined respectively. In the embodiments of the present disclosure, as the signal provided in the determination of the faulty data line is different from that in the determination of the faulty gate line, the embodiment of the present disclosure is schematically illustrated in the following two aspects.

Figure 6:
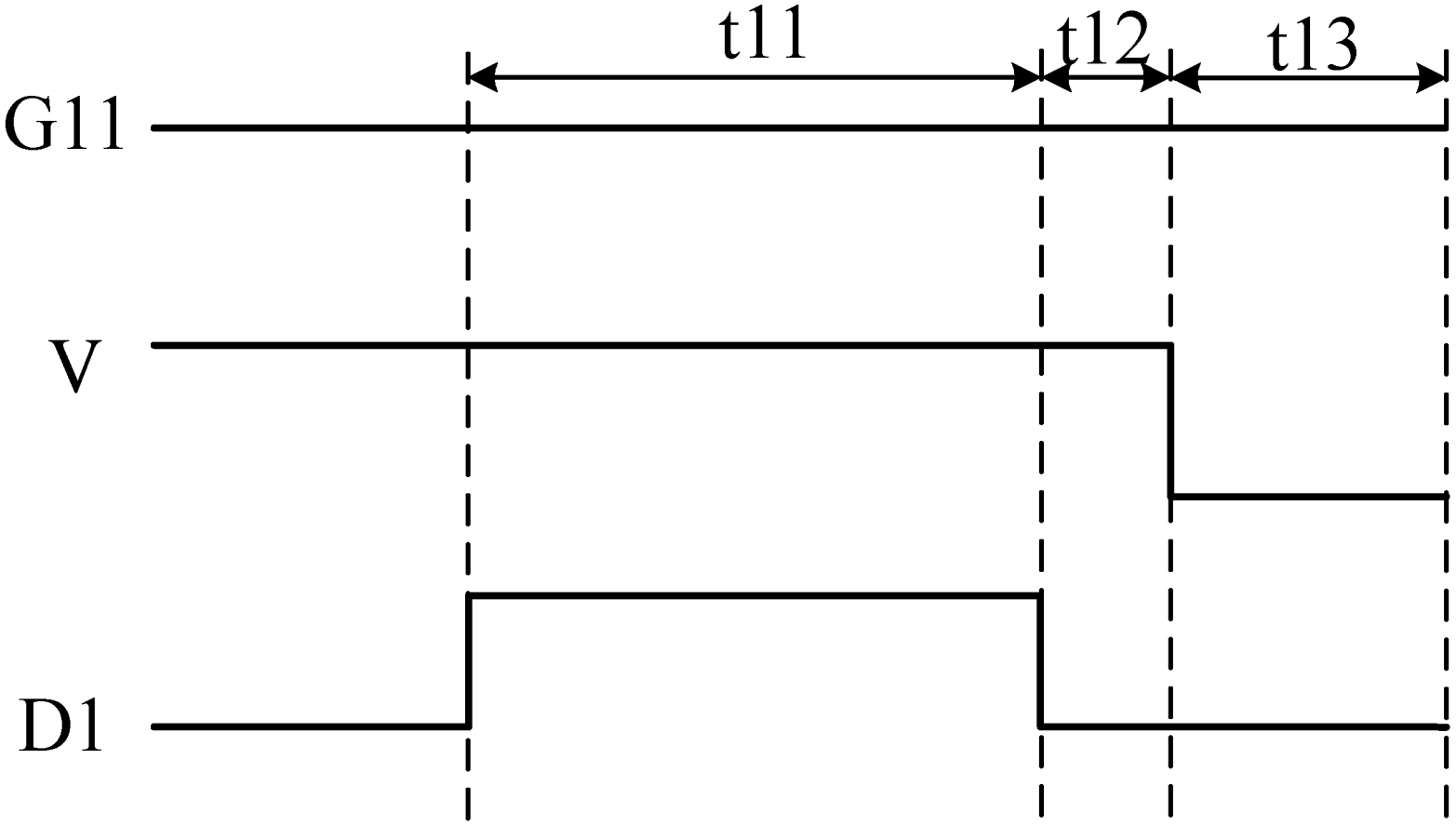
FIG. 6 is a timing sequence diagram of each signal end in a detection process provided in an embodiment of the present disclosure.

In an aspect, when it is required to determine a faulty data line, referring to FIG. 6 which is a timing sequence diagram of each signal end in a data line detection process provided in an embodiment of the present disclosure, a first detection component provides a first data signal D1 to a data input end D; and a second detection component provides a first gate line scan signal G11 to a gate electrode scan input end G1.

Figure 7:
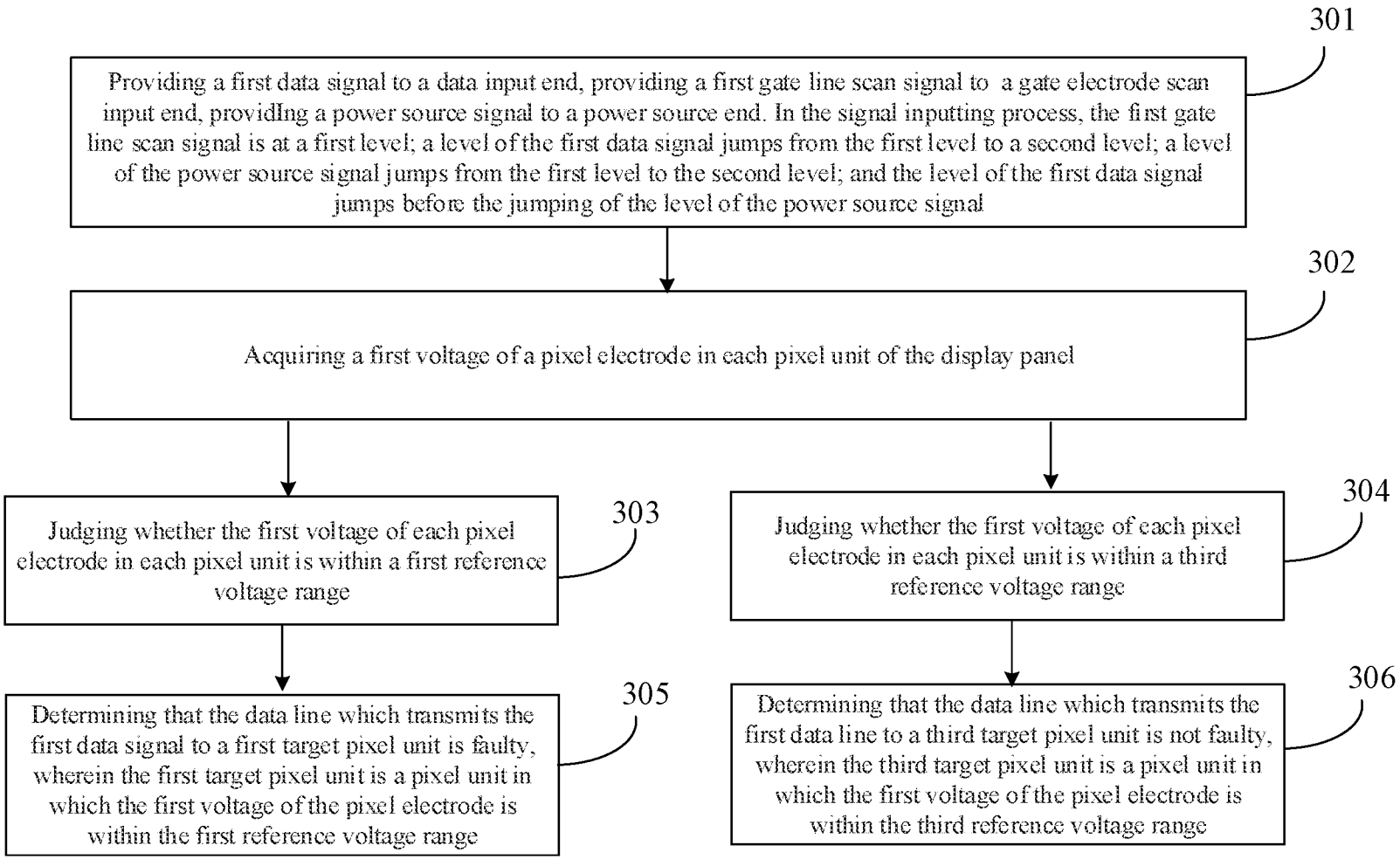
FIG. 7 is a flow chart of a detection method for another display panel provided in an embodiment of the present disclosure.

FIG. 7 is a flow chart of a detection method for another display panel provided in an embodiment of the present disclosure. The method is configured to detect the display panel shown in FIG. 1, and determine a short-circuited data line in the display panel. As shown in FIG. 7, the method may comprise the following steps.

In step 301, a first data signal is provided to a data input end, a first gate line scan signal is provided to a gate electrode scan input end, and a power source signal is provided to a power source end. In the signal inputting process, the first gate line scan signal is at a first level; a level of the first data signal jumps from the first level to a second level; a level of the power source signal jumps from the first level to the second level; and the level of the first data signal jumps before the jumping of the level of the power source signal.

For example, as shown in FIG. 6, the signal inputting process in the step 301 may be divided into three stages, namely, t11, t12 and t13. In the first stage t1, all the first gate line scan signal G11, the first data signal D1 and the power source signal V are at the first level; in the second stage t12, the first gate line scan signal G11 and the power source signal V are at the first level, and the first data signal D1 is at the second level; and in the third stage t13, the first gate line scan signal G11 is at the first level, and both the first data signal D1 and the power source signal V are at the second level.

Herein, when the first gate line scan signal G1 is at the first level, the voltage value may be 20 volts; when the first data signal D1 is at the first level, the voltage value may be 25 volts; when the first data signal D1 is at the second level, the voltage value may be −8 volts; when the power source signal V is at the first level, the voltage value may be 25 volts; and when the power source signal V is at the second level, the voltage value may be −15 volts.

As shown in FIGS. 2 and 6, the level of the first gate line scan signal G1 provided by the second signal input component to the gate electrode scan input end G1 does not jump during a detection process, and is always at the first level, so that the first transistor T1 is always in a turn-on state during the signal input process. When the gate line and the data line are both normal (that is, both the gate line and the data line can perform effective data transmission without failure such as short circuit, open circuit or others), if the first data signal D1 provided from the data input end D is at the first level, the second transistor T2 is in a turn-on state; or if the first data signal D1 is at the second level, the second transistor T2 is in a turn-off state. When the gate line and the data line are short-circuited, a potential of the first data signal D transmitted on the data line is affected by the first gate line scan signal G1 transmitted on the gate line. As a result, when the first data signal D1 provided by the data input end D is at the second level, the voltage on the data line is pulled up by the first gate line scan signal G11 transmitted on the gate line, so that the on-off state of the second transistor T2 is unaffected by the level of the first data signal D1, and the second transistor T2 is always in the turn-on state.

In step 302, a first voltage of each pixel electrode is acquired.

As shown in FIGS. 2 and 6, as the level of the first data signal D1 jumps before the jumping of the level of the power source signal V, if the gate line and the data line are both normal, it is detected that the first voltage of the pixel electrode X is always the voltage when the power source signal V is at the first level; or if the gate line and the data line are short-circuited, it can be detected that there are both the voltage when the power source signal V is at the first level and the voltage when the power source signal V is at the second level in the first voltage of the pixel electrode X.

When both the gate line and the data line are normal, the second transistor T2 may be in a turn-on state or in a turn-off state under the control of the first data signal D1. For instance, when the first data signal D1 is at the first level, the second transistor T2 is in a turn-on state. When the first data signal D1 is at the second level, the second transistor T2 is in a turn-off state. And when the second transistor T2 is in the turn-on state, the power source end VDD can charge the pixel storage capacitor Cst, so that the voltage difference between the two ends of the storage capacitor Cst is the voltage when the power source signal V is at the first level, and correspondingly, the first voltage of the pixel electrode X is the voltage when the power source signal V is at the first level. When the second transistor T2 is in the turn-off state, the pixel storage capacitor Cst is not discharged or charged, the voltage of the pixel electrode X is the voltage at one end of the storage capacitor Cst, and it can be measured that the first voltage of the pixel electrode X is also the voltage when the power source signal V is at the first level.

When the gate line and the data line are short-circuited, the second transistor T2 is always in the turn-on state under the influence of the first gate line scan signal G11 transmitted on the gate line. When the level of the power source signal V is jumped into the second level, the first voltage of the pixel electrode X becomes to be the voltage when the power source signal V is at the second level.

Figure 8:
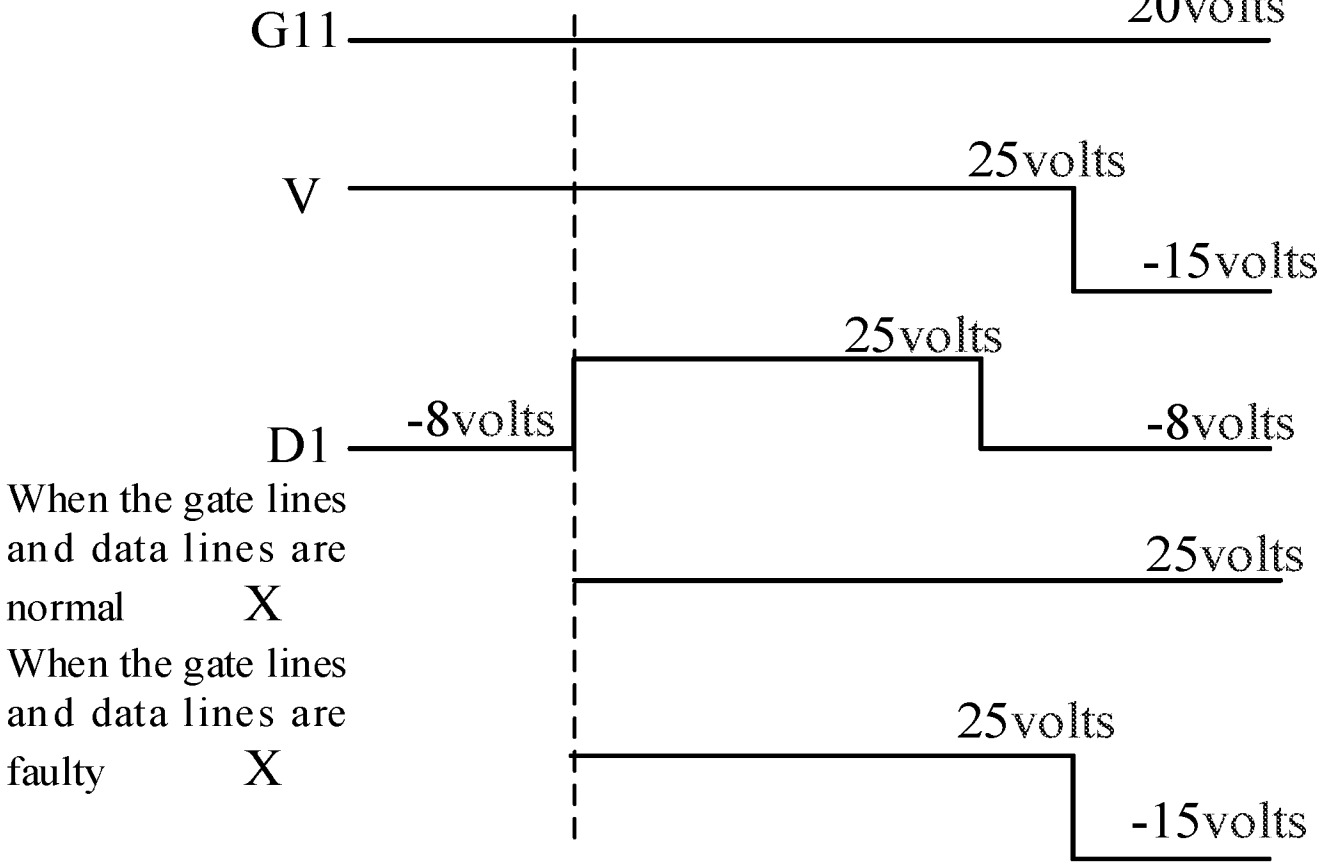
FIG. 8 is a diagram of an analogue simulation of a first voltage of a pixel electrode provided in an embodiment of the present disclosure.

For example, referring to FIG. 8, FIG. 8 is a diagram of an analogue simulation of a first voltage of a pixel electrode X provided in an embodiment of the present disclosure. When both the gate line and the data line are normal, the first voltage of the pixel electrode X is always the voltage when the power source signal V is at the first level, and it can be detected that the first voltage of the pixel electrode X is 25 volts. When the gate line and the data line are short-circuited, in the case of the first data signal D1 being at the first level, the first voltage of the pixel electrode X is the voltage when the power signal V is at the first level; in the case of the first data signal D1 being at the second level, the voltage on the data line is pulled high by the voltage of the gate line, so that the second transistor T2 is kept in a turn-on state; and in the case of the power signal V being at the second level, the first voltage of the pixel electrode X drops to the voltage when the power source signal V is at the second level, and it can be detected that the first voltage of the pixel electrode X is −15 volts.

Therefore, in the embodiments of the present disclosure, the first voltage of each pixel electrode X can be measured, and thus a short-circuited data line in the display panel can be judged according to the first voltage.

In step 303, it is judged whether the first voltage of the pixel electrode in each pixel unit is within a first reference voltage range.

Herein, the first reference voltage range may a preset reference voltage. A lower limit value in the first reference voltage range is greater than or equal to the voltage value when the power source signal V is at the second level.

In some embodiments, as shown in FIG. 2, due to the parasitic resistance which may be in the second transistor T2 and the effect of the equivalent resistance of the second transistor, the second transistor has an effect of a certain divided voltage. When the gate line and the data line are short-circuited and the power source signal V is at the second level, after the power source signal V is transmitted to the pixel electrode X, the first voltage of the pixel electrode X is less than the voltage when the power source signal is at the first level. Moreover, due to the divided voltage of the second transistor T2, the first voltage of the pixel electrode X may be possibly greater than the voltage when the power source signal is at the second level. For example, when the power source signal is at the second level, the voltage is −15 volts, from which 1 volt is divided by the second transistor T2, and the sum of the voltage drop across the second transistor T2 and the first voltage of the pixel electrode X should be equal to the voltage when the power source signal is at the second level. At this time, the first voltage of the pixel electrode X can be determined to be −14 volts, that is, the first voltage of the pixel electrode X is greater than the voltage when the power signal is at the second level. Correspondingly, it may be determined that the upper limit value of the first reference voltage range is less than or equal to the voltage value when the power signal V is at the first level, and the lower limit value of the first reference voltage range is greater than or equal to the voltage value when the power signal V is at the second level. Thus, when it is judged that the first voltage of the pixel electrode X in each pixel unit is within the first reference voltage range, step 305 may be executed.

In step 304, it is judged whether the first voltage of the pixel electrode in each pixel unit is within a third reference voltage range.

Herein, the third reference voltage may be a preset reference voltage. And a lower limit value in the third reference voltage range is greater than an upper limit value in the first reference voltage range.

In some embodiments, as shown in FIG. 2, when both the gate line and the data line are normal, due to the effect of divided voltage of the second transistor T2, the first voltage of the pixel electrode X may be less than the voltage when the power source signal V is at the first level and greater than the upper limit value in the first reference voltage range, thus when it is judged that the first voltage of the pixel electrode X in each pixel unit is within the third reference voltage range, step 306 may be executed.

In step 305, it is determined that the data line which transmits the first data signal to a first target pixel unit is faulty, wherein the first target pixel unit is a pixel unit in which the first voltage of the pixel electrode is within the first reference voltage range.

That is, it is determined that the data line corresponding to the pixel unit in which the first voltage is within the first reference voltage range is faulty.

Herein, the data line corresponding to the pixel unit refers to the data line connected to a driving circuit in the pixel unit, that is, the data line which transmits the first data signal to the pixel unit.

In step 306, it is determined that the data line which transmits the first data line to a third target pixel unit is not faulty, wherein the third target pixel unit is a pixel unit in which the first voltage of the pixel electrode is within the third reference voltage range.

That is to say, it is determined that the data line corresponding to the pixel unit in which the first voltage is within the third preset voltage range is normal.

It should be noted that when the first voltage is neither within the first reference voltage range nor within the third reference range, other faults may appear in the display panel.

It should be noted that in the embodiments of the present disclosure, the order of steps can be adjusted according to actual needs. For example, after executing the above step 302, step 303 may be executed first, and then step 304 is executed; or, steps 303 and 304 may be executed simultaneously.

Figure 9:
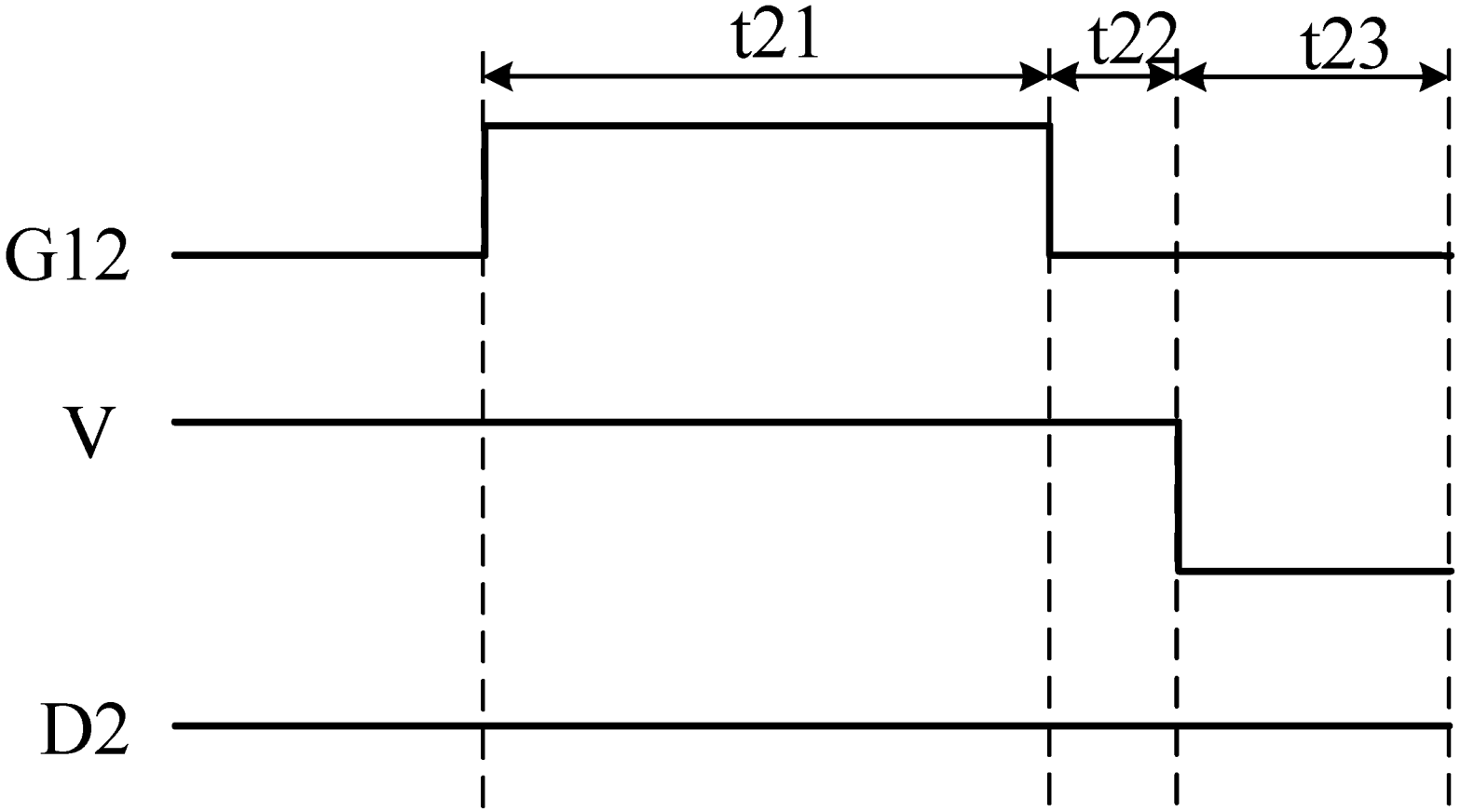
FIG. 9 is a timing sequence diagram of each signal end in another detection process provided in an embodiment of the present disclosure.

In another aspect, when it is required to determine a faulty gate line, referring to FIG. 9 which is a timing sequence diagram of each signal end in another gate line detection process provided in an embodiment of the present disclosure, a first detection component provides a second data signal D2 to a data input end D; and a second detection component transmits a second gate line scan signal G12 to a gate electrode scan input end G1.

Figure 10:
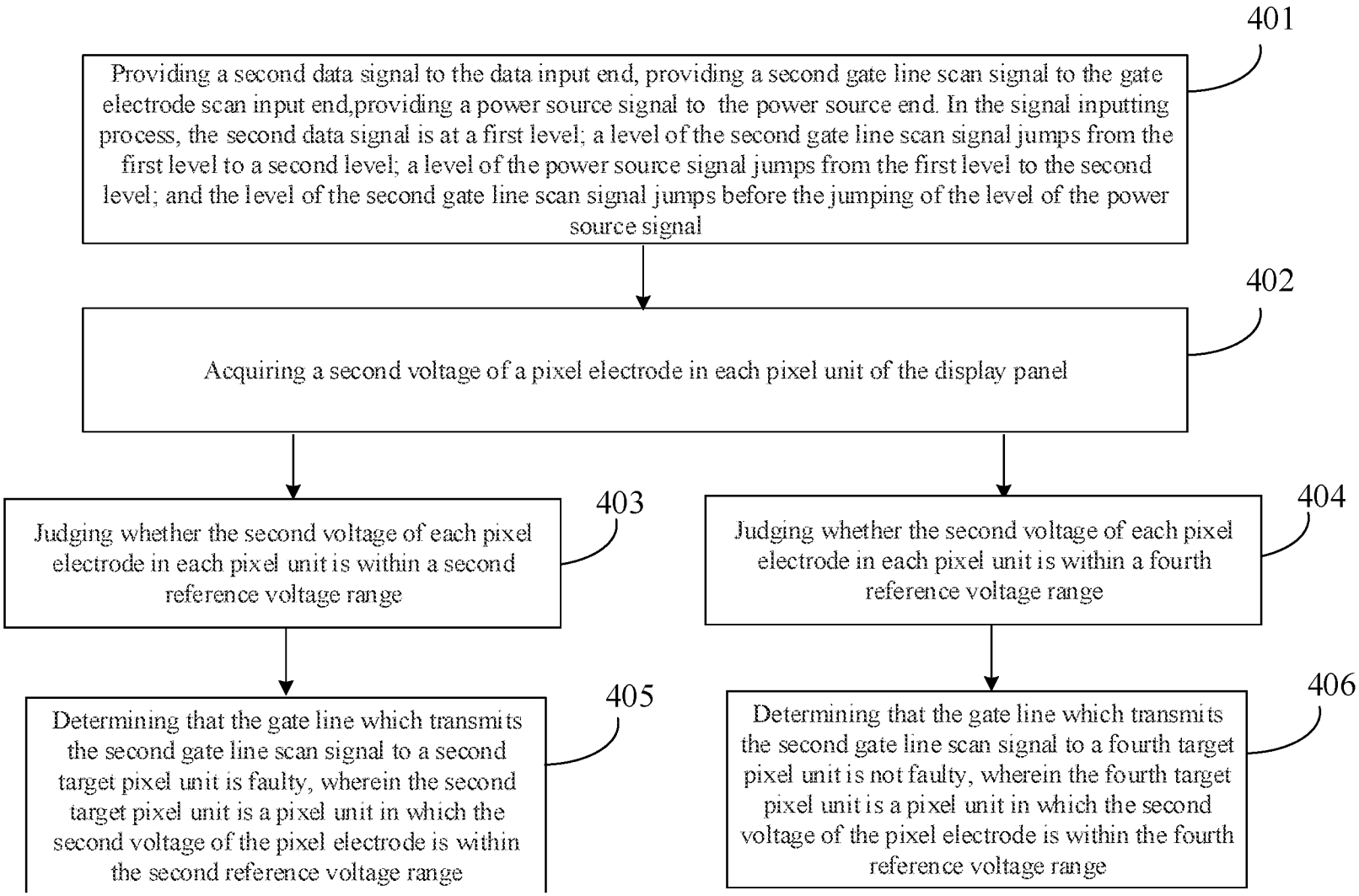
FIG. 10 is a flow chart of a detection method for yet another display panel provided in an embodiment of the present disclosure.

FIG. 10 is a flow chart of a detection method for yet another display panel provided in the embodiment of the present disclosure. The method is configured to detect the display panel shown in FIG. 1, and determine a short-circuited gate line in the display panel. As shown in FIG. 10, the method may comprise the following steps.

In step 401, a second data signal is provided to the data input end, a second gate line scan signal is provided to the gate electrode scan input end, and a power source signal is provided to the power source end. In the signal inputting process, the second data signal is at a first level; a level of the second gate line scan signal jumps from the first level to a second level; a level of the power source signal jumps from the first level to the second level; and the level of the second gate line scan signal jumps before the jumping of the level of the power source signal.

For example, as shown in FIG. 9, the signal inputting process in step 401 may be divided into three stages, namely, t21, t22 and t23. In the first stage t1, all the second gate line scan signal G12, the second data signal D2 and the power source signal V are at the first level; in the second stage t22, both the second data signal D2 and the power source signal V are at the first level, and the second gate line scan signal G12 is at the second level; and in the third stage t23, the second data signal D2 is at the first level, both the second gate line scan signal G12 and the power source signal V are at the second level.

Herein, when the second data signal D2 is at the first level, the voltage value may be 8 volts; when the second gate line scan signal G12 is at the first level, the voltage value may be 25 volts; and when the second gate line scan signal G12 is at the second level, the voltage value may be −25 volts.

As shown in FIGS. 2 and 9, in a signal transmission process, when both the gate line and the data line are normal, if the second gate line scan signal G12 provided by the gate electrode scan input end G1 is at the first level, the first transistor T1 is in a turn-on state; or if the second gate line scan signal G12 is at the second level, the first transistor T1 is in a turn-off state. In a detection process, the level of the second data signal D2 provided by the first signal input component to the data input end D does not jump, and is always at the first level, so that when the first transistor T1 is in the turn-on state, the second transistor T2 is also in the turn-on state; and when the first transistor T1 is in the turn-off state, the second transistor T2 is also in the turn-off state. When the gate line and the data line are short-circuited, a potential of the second gate line scan signal transmitted on the gate line is affected by the second data signal D2 transmitted on the data line. As a result, when the second gate line scan signal G12 provided from the gate electrode scan input end G1 is at the second level, the voltage on the gate line is pulled up by the second data signal D2 transmitted on the data line, so that the on-off state of the first transistor T1 is unaffected by the level of the second gate line scan signal G12, and the first transistor T1 is always in the turn-on state. In addition, as the level of the second data signal D2 by from the data input end D does not jump, and is always at the first level, the second transistor T2 is always in the turn-on state in a signal input process.

In step 402, a second voltage of a pixel electrode is acquired.

As shown in FIGS. 2 and 9, as the level of the second gate line scan signal G12 jumps before the jumping of the level of the power source signal V, if the gate line and the data line are both normal, it can be detected that there is no voltage when the power source signal V is at the second level in the second voltage of the pixel electrode X is, that is, the second voltages are all signals when the power source signal V is at the first level; or if the gate line and the data line are short-circuited, it can be detected that the second voltage of the pixel electrode X includes the voltage when the power source signal V is at the second level.

For example, when both the gate line and the data line are normal, the first transistor T1 may be in a turn-on state or in a turn-off state under the control of the second gate line scan signal G12. And when the first transistor T1 is in the turn-on state, the second transistor T2 is also in the turn-on state, and the voltage end VDD can charge the pixel storage capacitor Cst, so that the voltage difference between the two ends of the storage capacitor Cst are the voltage when the power source signal V is at the first level, and correspondingly, the second voltage of the pixel electrode X is the voltage when the power source signal V is at the first level. When the first transistor T1 is in the turn-off state, under the action of discharging of the pixel storage capacitor Cst, the second transistor T2 cannot be turned off immediately. After the discharging of the pixel storage capacitor Cst is completed, the second transistor T2 is in the turn-off state. During the discharging process of the capacitor Cst, the voltage difference between the two ends of the storage capacitor Cst drop continuously, so that the voltage of the pixel electrode ITO continues to drop, and the second voltage of the pixel electrode ITO stops to drop until the second transistor T2 is in the turn-off state. Therefore, when both the gate line and the data line are normal, after the second gate line scan signal G12 jumps to be at the second level, the second voltage of the pixel electrode X dropped slightly, and the dropped second voltage is still greater than the voltage when the power source signal V is at the second level.

When the gate line and the data line are short-circuited, as the first transistor T1 is always in a turn-on state under the influence of the second data signal D2 transmitted on the data line, the second transistor T2 is also in the turn-on state; and at this time, it can be measured that the second voltage of the pixel electrode X includes the voltage when the power source signal V is at the second level.

Figure 11:
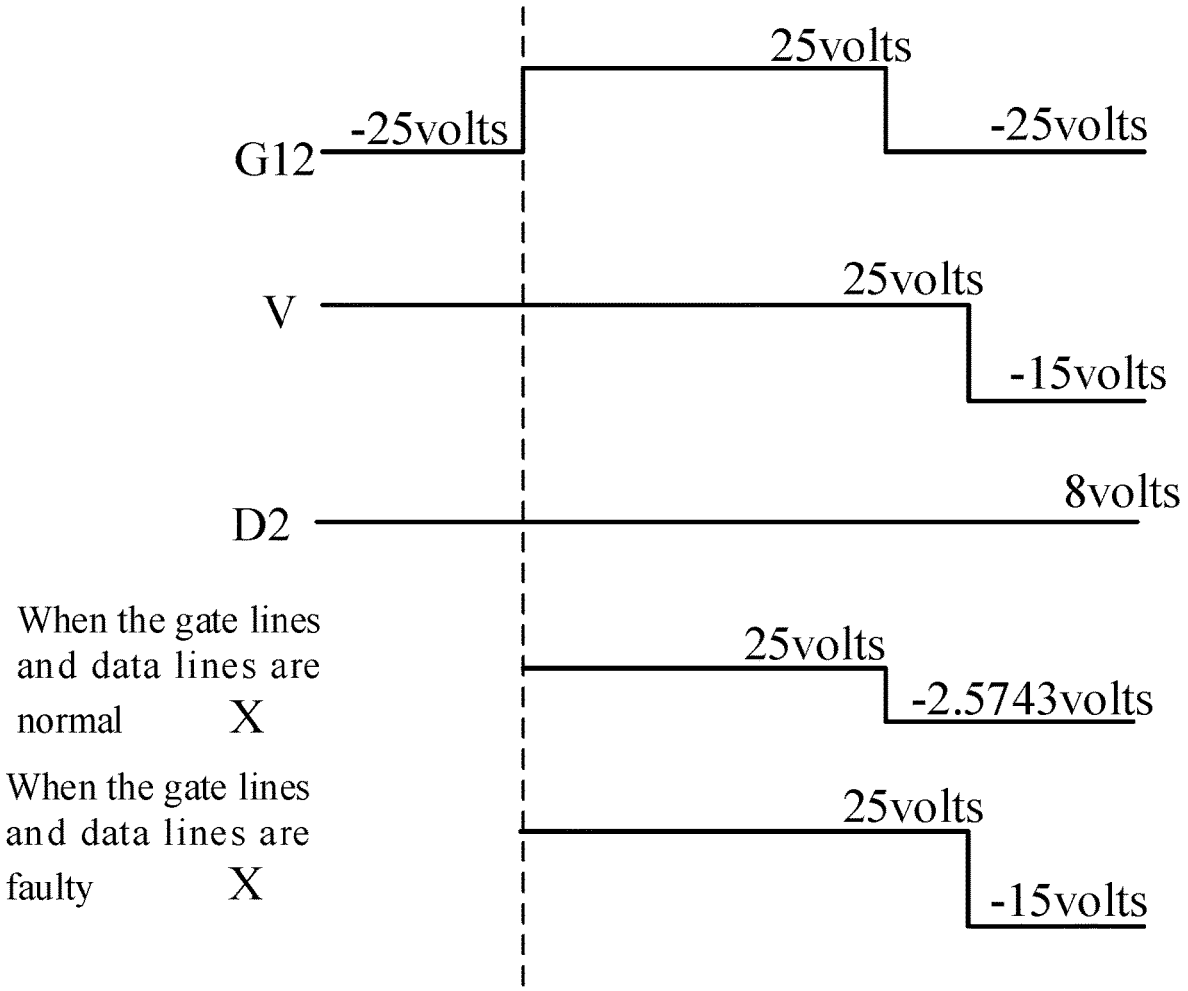
FIG. 11 is a diagram of an analogue simulation of a second voltage of a pixel electrode provided in an embodiment of the present disclosure.

For example, referring to FIG. 11, FIG. 11 is a diagram of an analogue simulation of a second voltage of a pixel electrode X provided in an embodiment of the present disclosure. When both the gate line and the data line are normal, after the second voltage of the pixel electrode X drops to −2.5743 volts, the second transistor T2 is turned off, and finally, it can be measured that the second voltage of the pixel electrode ITO is −2.5743 volts. When the gate line and the data line are short-circuited, in the case of the second gate line scan signal G12 being at the first level, the first voltage of the pixel electrode X is the voltage when the power source signal V is at the first level, and after the second gate line scan signal G12 is jumped to be at the second level, the voltage on the gate line is pulled high by the voltage of the first data signal D1, so that the first transistor T1 and the second transistor T2 are both kept in a turn-on state; when the power source signal V jumps to be at the second level, the second voltage of the pixel electrode X drops to the voltage when the power source signal V is at the second level, and finally, it can be measured that the second voltage of the pixel electrode X is −15 volts.

Therefore, in the embodiments of the present disclosure, the second voltage of each pixel electrode X can be acquired, and thus a short-circuited gate line in the display panel can be judged according to the second voltage.

In step 403, it is judged whether the second voltage of each pixel electrode is within a second reference voltage range.

Herein, a second reference voltage may be a preset reference voltage. And a lower limit value in the second reference voltage range is greater than or equal to the voltage value when the power source signal V is at the second level.

In some embodiments, as shown in FIG. 2, due to the parasitic resistance which may be in the second transistor T2 and the effect of the equivalent resistance of the second transistor, the second transistor has an effect of a certain divided voltage. When the gate line and the data line are short-circuited and the power source signal V is at the second level, after the power source signal V is transmitted to the pixel electrode X, the first voltage of the pixel electrode X is less than the voltage when the power source signal is at the first level. Moreover, due to the divided voltage of the second transistor T2, the second voltage of the pixel electrode X may be possibly greater than the voltage when the power source signal V is at the second level. As a result, when it is judged that the second voltage of the pixel electrode X in each pixel unit is within the second reference voltage range, step 405 may be executed.

It should be noted that the first reference voltage range and the second reference voltage range provided in the embodiments of the present disclosure are the same. That is, values included in the first reference voltage range are the same as those included in the second reference voltage range. Optionally, the first reference voltage range and the second reference voltage range may also be different, and the range may be determined according to actual needs.

In step 404, it is judged whether the second voltage of the pixel electrode in each pixel unit is within a fourth reference voltage range.

Herein, the fourth reference voltage may be a preset reference voltage. And a lower limit value in the fourth reference voltage range is greater than an upper limit value in the second reference voltage range.

In some embodiments, as shown in FIG. 2, when the gate line and the data line are both normal, due to the voltage division of the second transistor T2, the first voltage of the pixel electrode X may be less than the voltage when the power signal V is at the first level, and greater than the upper limit value of the second reference voltage range. Thus, when it is judged that the second voltage of the pixel electrode X in each pixel unit is within the fourth reference voltage range, step 406 may be executed.

In step 405, it is determined that the gate line which transmits the second gate line scan signal to a second target pixel unit is faulty, wherein the second target pixel unit is a pixel unit in which the second voltage of the pixel electrode is within the second reference voltage range;

That is to say, it is determined that the gate line corresponding to the pixel unit in which the second voltage is within the second reference voltage range is faulty.

Herein, the gate line corresponding to the pixel unit refers to the gate line connected to the driving circuit in the pixel unit, that is, the gate line which transmits the second gate line scan signal to the pixel unit.

In step 406, it is determined that the gate line which transmits the second gate line scan signal to a fourth target pixel unit is not faulty, wherein the fourth target pixel unit is a pixel unit in which the second voltage of the pixel electrode is within the fourth reference voltage range.

That is, it is determined that the gate line corresponding to the pixel unit in which the second voltage is within the fourth reference voltage range is normal.

It should be noted that when the second voltage is neither within the second reference voltage range nor within the fourth reference range, other faults may appear in the display panel.

It should be noted that in the embodiments of the present disclosure, the orders of steps may be adjusted according to actual needs. For example, after executing the above step 402, step 403 may be executed first, and then step 404 is executed; or, steps 403 and 404 may be executed simultaneously.

It should be noted that after step 305 and step 405 in the above embodiments, the faulty gate line and the faulty data line can be determined; and a position of a defective point in the display panel may be determined in accordance with the faulty gate line and the faulty data line, so that the gate line and the data line corresponding to the defective point can be repaired, thereby improving the product yield of the display panel.

It should be noted that a sequence of the steps of the detection method for the display panel provided by the embodiments of the present disclosure may be appropriately adjusted, and the steps may also be correspondingly increased or decreased in accordance with a situation. For example, the faulty gate line may be determined first, and then the faulty data line may be determined. That is, the steps in FIG. 10 are executed first, and then the steps in FIG. 7 are executed. Any variation methods which can be easily expected by any person skilled in the art within the technical scope disclosed by the present disclosure should be covered in the protection scope of the present disclosure, which is not repeated herein.

In summary, in the detection method for the display panel provided in the embodiments of the present disclosure, during a process of providing the first data signal, the first gate line scan signal and the power source signal, the first voltage of each pixel electrode is acquired; the faulty data line is determined in accordance with the change of first voltage during the process; during a process of providing the second data signal, the second gate line scan signal and the power source signal, the second voltage of each pixel electrode is acquired; and the faulty gate line is determined in accordance with the change of second voltage during the process, thereby detecting the faulty data line and the faulty gate line quickly and effectively. And the position of the defective point in the display panel is determined in accordance with the faulty gate line and the faulty data line, which improves the efficiency of detecting the display panel. Moreover, after the position of the defective point in the display panel is determined, the gate line and the data line that correspond to the defective point can be repaired, so that the product yield of the display panel can be improved.

Figure 12:
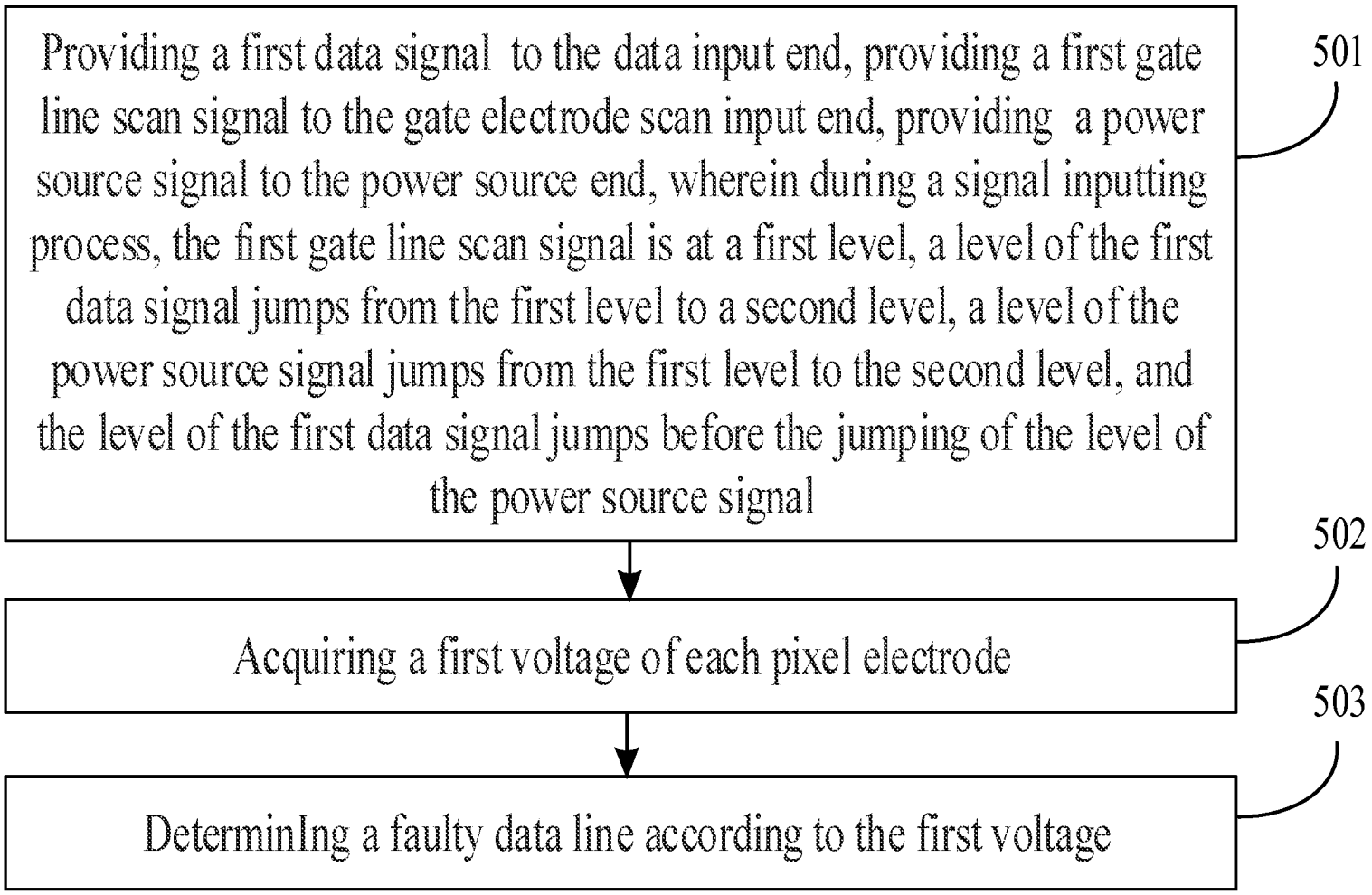
FIG. 12 is a flow chart of a detection method for still yet another display panel provided in an embodiment of the present disclosure

There is also provided a detection method for a display panel in an embodiment of the present disclosure. FIG. 12 is a flow chart of a detection method for still yet another display panel provided in an embodiment of the present disclosure. As shown in FIG. 12, the method is used to detect the display panel illustrated in FIG. 1, and determine the faulty data line in the display panel. The method may comprise the following steps.

In step 501, a first data signal is provided to the data input end, a first gate line scan signal is provided to the gate electrode scan input end, and a power source signal is provided to the power source end, wherein during a signal inputting process, the first gate line scan signal is at a first level, a level of the first data signal jumps from the first level to a second level, a level of the power source signal jumps from the first level to the second level, and the level of the first data signal jumps before the jumping of the level of the power source signal.

The implementation process of step 501 may correspondingly refer to the implementation process of step 301.

In step 502, a first voltage of each pixel electrode is acquired.

The implementation process of step 502 may correspondingly refer to the implementation process of step 302.

In step 503, a faulty data line is determined according to the first voltage.

The implementation process of step 503 may correspondingly refer to the implementation processes of step 303 and step 305.

In summary, in the detection method for the display panel provided in the embodiments of the present disclosure, during a process of providing the first data signal, the first gate line scan signal and the power source signal, the first voltage of each pixel electrode is acquired; and the faulty gate line is determined in accordance with the change of the first voltage during the process. Compared with the related art, the faulty gate line can be detected quickly and effectively, and the efficiency of detecting the display panel can be improved.

In an embodiment of the present disclosure, the method may further include: detecting a faulty gate line. Correspondingly, the position of the defective point in the display panel can be determined according to the faulty grid line and the faulty data line. The implementation of detecting the faulty gate line may refer to the implementation manner of the detection gate line in the foregoing embodiments, for example, may correspondingly refer to steps 401 to 406.

Figure 13:
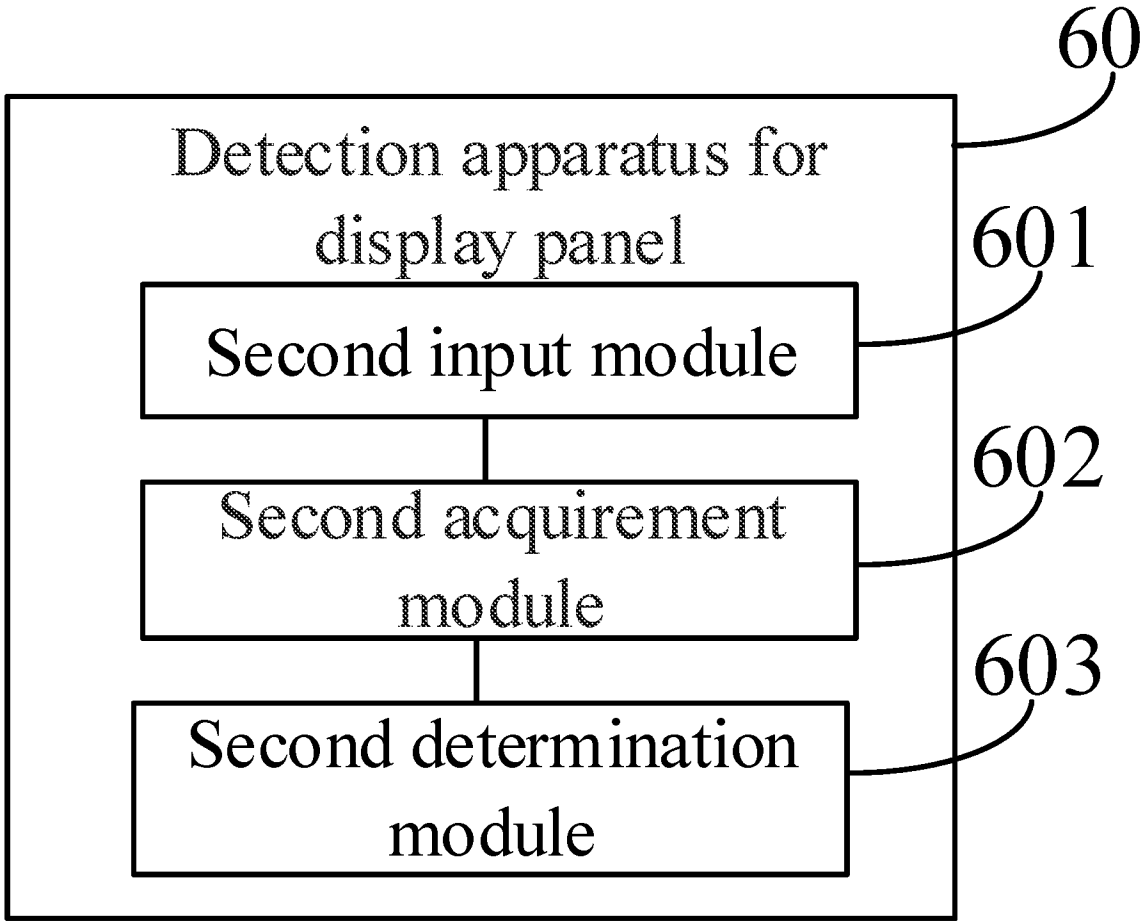
FIG. 13 is a block diagram of a detection apparatus for a display panel provided in an embodiment of the present disclosure.

An embodiment of the present disclosure further provides a detection apparatus for a display panel. The display panel may comprise a plurality of data lines, a plurality of gate lines, and a plurality of pixel units enclosed by the plurality of data lines and the plurality of gate lines in an intersected manner; at least a part of the pixel units comprises a driving circuit and a pixel electrode; and the driving circuit is further connected to a data input end, a gate electrode scan input end and a power source end, respectively. As shown in FIG. 13, the detection apparatus 60 for the display panel may comprise:

a second input module 601 configured to provide a second data signal to the data input end, provide a second gate line scan signal to the gate electrode scan input end, and provide a power source signal to the power source end, wherein in the signal input process, the second data signal is at a first level; a level of the second gate line scan signal jumps from the first level to a second level; a level of the power source signal jumps from the first level to the second level; the level of the second gate line scan signal jumps before the jumping of the level of the power source signal;

a second acquirement module 602 configured to acquire a second voltage of each pixel electrode; and a second determination module 603 configured to determine a faulty gate line in accordance with the second voltage.

Optionally, the second determination module 603 is configured to: judge whether the second voltage of each pixel electrode is within a second reference voltage range; and determine that the gate line which transmits the second gate line scan signal to a second target pixel unit is faulty, wherein the second target pixel unit is a pixel unit in which the second voltage of the pixel electrode is within the second reference voltage range.

Herein, a lower limit value in the second reference voltage range is greater than or equal to a voltage value when the power source signal is at the second level.

Figure 14:
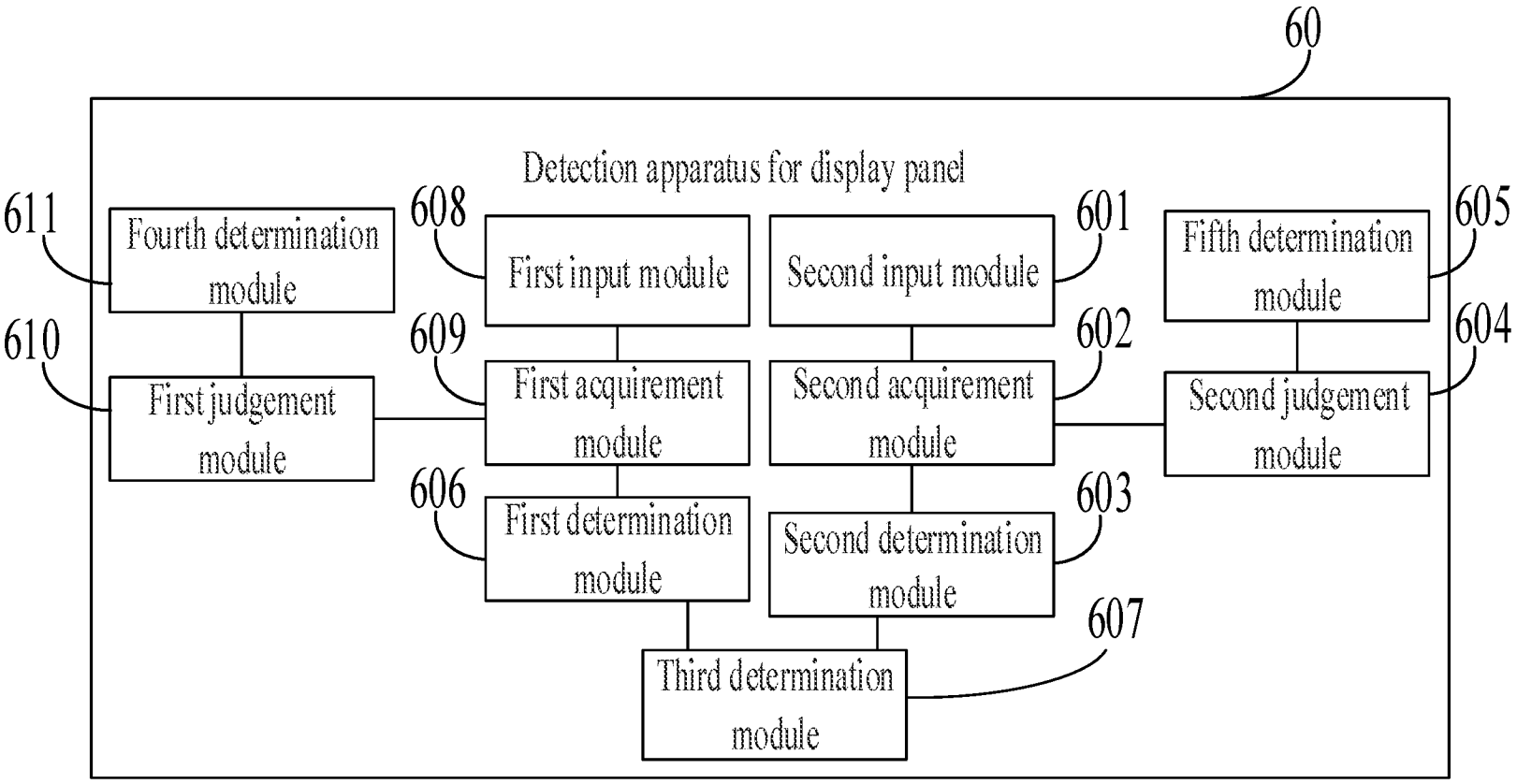
FIG. 14 is a block diagram of a detection apparatus for another display panel provided in an embodiment of the present disclosure.

Optionally, as shown in FIG. 14, the apparatus 60 further comprises:

a second judgement module 604 configured to judge whether the second voltage of each pixel electrode is within a fourth reference voltage range; and a fifth determination module 605 configured to determine that the gate line which transmits the second gate line scan signal to a fourth target pixel unit is not faulty, wherein the fourth target pixel unit is a pixel unit in which the second voltage of the pixel electrode is within the fourth reference voltage range.

Herein, a lower limit value in the fourth reference voltage range is greater than an upper limit value in the second reference voltage range.

Optionally, as shown in FIG. 14, the detection apparatus for the display panel may comprise:

a first determination module 606 configured to determine a faulty data line, and a third determination module 607 configured to determine a position of a defective point in the display panel in accordance with the faulty gate line and the faulty data line. Optionally, the defective point is a short-circuited defective point.

Exemplarily, as shown in FIG. 14, the detection apparatus 60 for the display panel may comprise:

a first input module 608 configured to provide a first data signal to a data input end, provide a first gate line scan signal to a gate electrode scan input end, and provide a power source signal, to a power source end, wherein in a signal input process, the first gate line scan signal is at a first level; a level of the first data signal jumps from the first level to a second level; a level of the power source signal jumps from the first level to the second level; and the level of the first data signal jumps before the jumping of the level of the power source signal;

a first acquirement module 609 configured to acquire a first voltage of each pixel electrode; and a first determination module 606 configured to determine a faulty data line in accordance with the first voltage.

Optionally, the first determination module 606 is configured to: judge whether the first voltage of each pixel electrode is within a first reference voltage range; and determine that the data line which transmits the first data signal to a first target pixel unit is faulty, wherein the first target pixel unit is a pixel unit in which the first voltage of the pixel electrode is within the first reference voltage range.

Herein, a lower limit value in the first reference voltage range is greater than or equal to a voltage value when the power source signal is at the second level.

Optionally, as shown in FIG. 14, the apparatus 60 further comprises:

a first judgement module 610 configured to judge whether the first voltage of each pixel electrode is within a third reference voltage range; and a fourth determination module 611 configured to determine that the data line which transmits the first data signal to a third target pixel unit is not faulty, wherein the third target pixel unit is a pixel unit in which the first voltage of the pixel electrode is within the third reference voltage range.

Herein, a lower limit value in the third reference voltage range is greater than an upper limit value in the first reference voltage range.

Optionally, an occurrence of the defective point in the display panel refers to that the gate line and the data line in the display panel are short-circuited.

Optionally, when the first gate line scan signal is at the first level, the voltage value is 20 volts; when the first data signal is at the first level, the voltage value is 25 volts; when the first data signal is at the second level, the voltage value is −8 volts; when the power source signal is at the first level, the voltage value is 25 volts; when the power source signal is at the second level, the voltage value is −15 volts.

When the second data signal is at the first level, the voltage value is 8 volts; when the second gate line scan signal is at the first level, the voltage value is 25 volts; and when the second gate line scan signal is at the second level, the voltage value is −25 volts.

In summary, in the detection apparatus for the display panel provided in the embodiments of the present disclosure, during a process of providing the first data signal, the first gate line scan signal and the power source signal, the first voltage of each pixel electrode is acquired; the faulty data line is determined in accordance with the change of first voltage during the process; during a process of providing the second data signal, the second gate line scan signal and the power source signal, the second voltage of each pixel electrode is acquired; and the faulty gate line is determined in accordance with the change of second voltage during the process, thereby detecting the faulty data line and the faulty gate line quickly and effectively. And the position of the defective point in the display panel is determined in accordance with the faulty gate line and the faulty data line, which improves the efficiency of detecting the display panel. Moreover, after the position of the defective point in the display panel is determined, the gate line and the data line corresponding to the defective point can be repaired, so that the product yield of the display panel can be improved.

Figure 15:
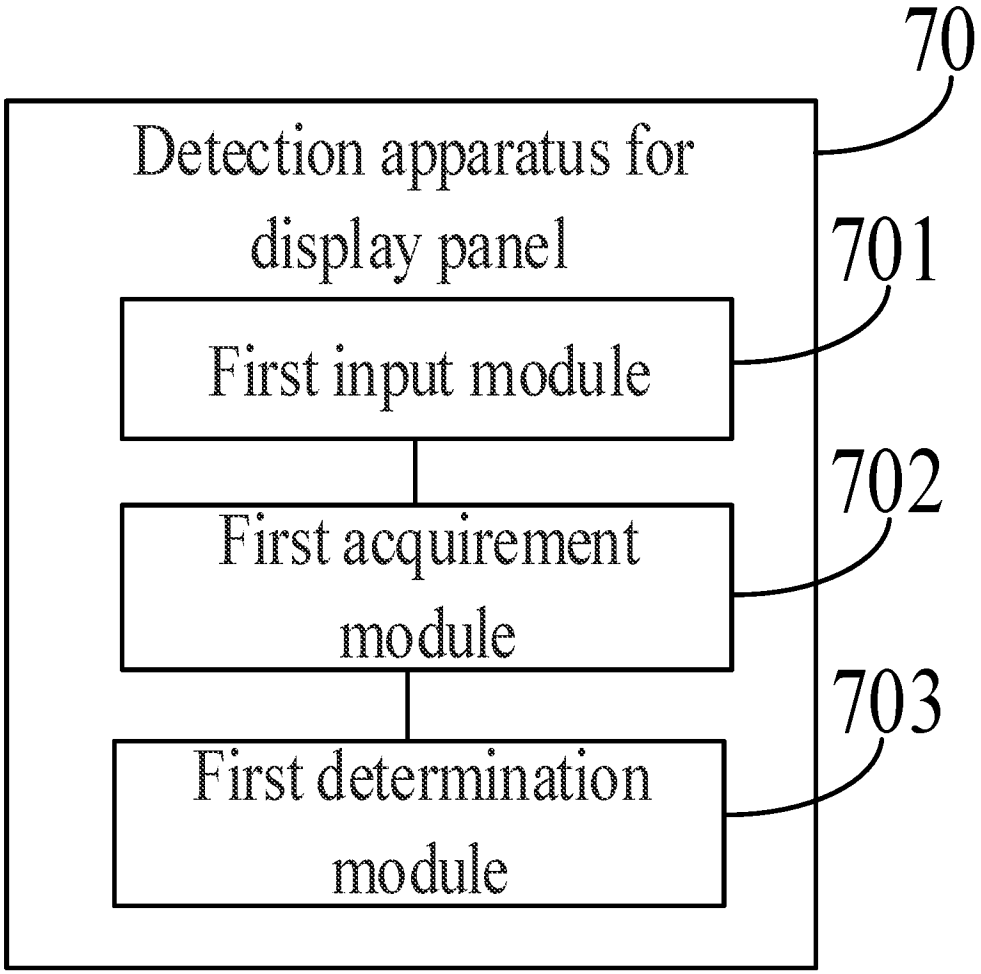
FIG. 15 is a block diagram of a detection apparatus for yet another display panel provided in an embodiment of the present disclosure.

There is further provided a detection apparatus for a display panel in an embodiment of the present disclosure. The display panel comprises a plurality of data lines, a plurality of gate lines, and a plurality of pixel units enclosed by the plurality of data lines and the plurality of gate lines in an intersected manner; at least a part of the pixel units comprises a driving circuit and a pixel electrode that are connected with each other: the driving circuit is further connected to a data input end, a gate electrode scan input end and a power source end, respectively. As shown in FIG. 15, the apparatus 70 comprises:

a first input module 701 configured to provide a first data signal to the data input end, provide a first gate line scan signal to the gate electrode scan input end, and provide a power source signal to the power source end, wherein during a signal inputting process, the first gate line scan signal is at a first level, a level of the first data signal jumps from the first level to a second level, a level of the power source signal jumps from the first level to the second level, and the level of the first data signal jumps before the jumping of the level of the power source signal;

a first acquirement module 702 configured to acquire a first voltage of each pixel electrode; and a first determination module 703 configured to determine a faulty data line according to the first voltage.

Optionally, the first determination module 703 is configured to judged whether the first voltage of each pixel electrode is within a first reference voltage range, and determine that the data line which transmits the first data signal to a first target pixel unit is faulty, wherein the first target pixel unit is a pixel unit in which the first voltage of the pixel electrode is within the first reference voltage range, wherein a lower limit value of the first reference voltage range is greater than or equal to a voltage value when the power source signal is at the second level.

Figure 16:
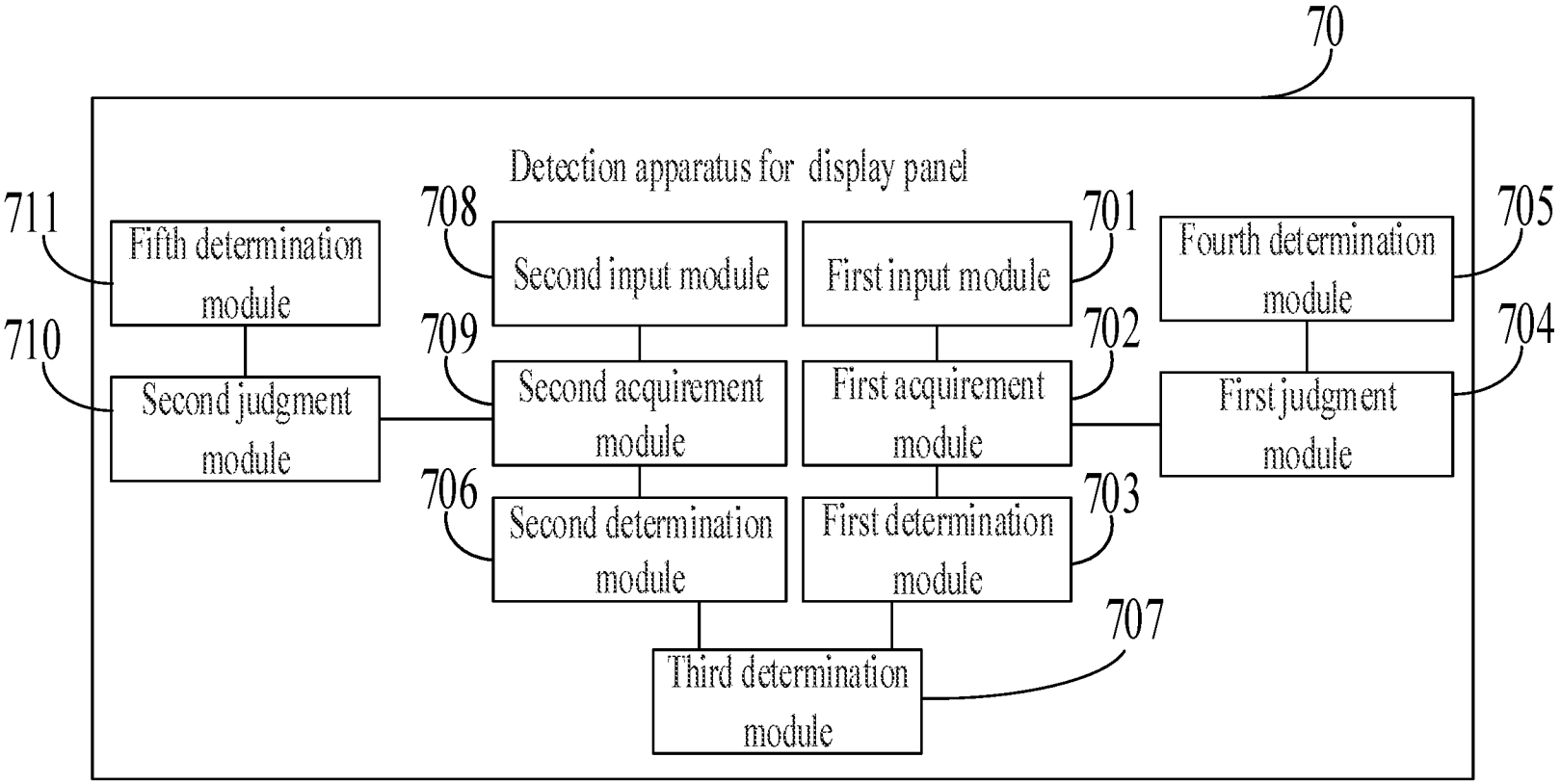
FIG. 16 is a block diagram of a detection apparatus for still yet another display panel provided in an embodiment of the present disclosure.

Optionally, as shown in FIG. 16, the apparatus further comprises:

Optionally, the second determination module 506 is configured to a first judgment module 704 configured to judge whether the first voltage of each pixel electrode is within a third reference voltage range; and a fourth determination module 705 configured to determine that the data line which transmits the first data signal to a third target pixel unit is not faulty, wherein the third target pixel unit is a pixel unit in which the first voltage of the pixel electrode is within the third reference voltage range.

Herein, a lower limit value in the third reference voltage range is greater than an upper limit value in the first reference voltage range.

Optionally, as shown in FIG. 16, the apparatus further comprises:

a second determination module 706 configured to determine a faulty gate line; and a third determination module 707 configured to determine a position of a defective point in the display panel according to the faulty gate line and the faulty data line.

Optionally, as shown in FIG. 16, the detection apparatus 70 of the display panel may comprise:

a second input module 708 configured to provide a second data signal to the data input end, provide a second gate line scan signal to the gate electrode scan input end, and provide a power source signal to the power source end, wherein during a signal inputting process, the second data signal is at a first level, a level of the second gate line scan signal jumps from the first level to a second level, a level of the power source signal jumps from the first level to the second level, and the level of the second gate line scan signal jumps before the jumping of the level of the power source signal;

a second acquirement module 709 configured to acquire a second voltage of each pixel electrode; and a second determination module 706 configured to determine a faulty gate line according to the second voltage.

Optionally, the second determination module 706 is configured to:

judge whether the second voltage of each pixel electrode is within a second reference voltage range; and determine that the gate line which transmits the second gate line scan signal to a second target pixel unit is faulty, wherein the second target pixel unit is a pixel unit in which the second voltage of the pixel electrode is within the second reference voltage range; wherein a lower limit value in the second reference voltage range is greater than or equal to a voltage value when the power source signal is at the second level.

Optionally, as shown in FIG. 16, the apparatus 70 further comprises:

a second judgment module 710 configured to judge whether the second voltage of the pixel electrode in each pixel unit is within a fourth reference voltage range; and a fifth determination module 711 configured to determine that the gate line which transmits the second gate line scan signal to a fourth target pixel unit is not faulty, wherein the fourth target pixel unit is a pixel unit in which the second voltage of the pixel electrode is within the fourth reference voltage range.

Herein, a lower limit value in the fourth reference voltage range is greater than an upper limit value in the second reference voltage range.

Optionally, an occurrence of the defective point in the display panel refers to the gate line and the data line in the display panel are short-circuited.

In some embodiments, when the first gate line scan signal is at the first level, the voltage value is 20 volts; when the first data signal is at the first level, the voltage value is 25 volts; when the first data signal is at the second level, the voltage value is −8 volts; when the power source signal is at the first level, the voltage value is 25 volts; when the power source signal is at the second level, the voltage value is −15 volts; when the second data signal is at the first level, the voltage value is 8 volts; when the second gate line scan signal is at the first level, the voltage value is 25 volts; and when the second gate line scan signal is at the second level, the voltage value is −25 volts.

A person skilled in the art can easily understand that for the sake of convent and brief description, a particular working process of the above apparatus can refer to a corresponding process in the foregoing method embodiments, and details are not repeated herein.

In summary, in the detection apparatus for the display panel provided in the embodiments of the present disclosure, during a process of providing the first data signal, the first gate line scan signal and the power source signal by the first input module, the first voltage of each pixel electrode is acquired by the first acquirement module; the faulty data line is determined by the first determination module in accordance with the change of first voltage during the process; during a process of providing the second data signal, the second gate line scan signal and the power source signal by the second input module, the second voltage of each pixel electrode is acquired by the second acquirement module; and the faulty gate line is determined by the second determination module in accordance with the change of second voltage in the process, thereby detecting the faulty data line and the faulty gate line quickly and effectively. And the position of the defective point in the display panel is determined in accordance with the faulty gate line and the faulty data line, which improves the efficiency of detecting the display panel. Moreover, after the position of the defective point in the display panel is determined, the gate line and the data line corresponding to the defective point can be repaired, so that the product yield of the display panel can be improved.

An embodiment of the present disclosure further provides a detection device for detecting a display panel shown in FIG. 1. The detection device comprises:

a processor; and a memory.

The memory stores at least one program which are configured to be executed by the processor. The at least one program includes a detection method for a display panel according to the above steps 101 to 103, or include a detection method for a display panel according to the above steps 201 to 207, or a detection method for a display panel according to the above steps 301 to 306, or a detection method for a display panel according to the above steps 401 to 406, or a detection method for a display panel according to the above steps 501 to 503.

Figure 17:
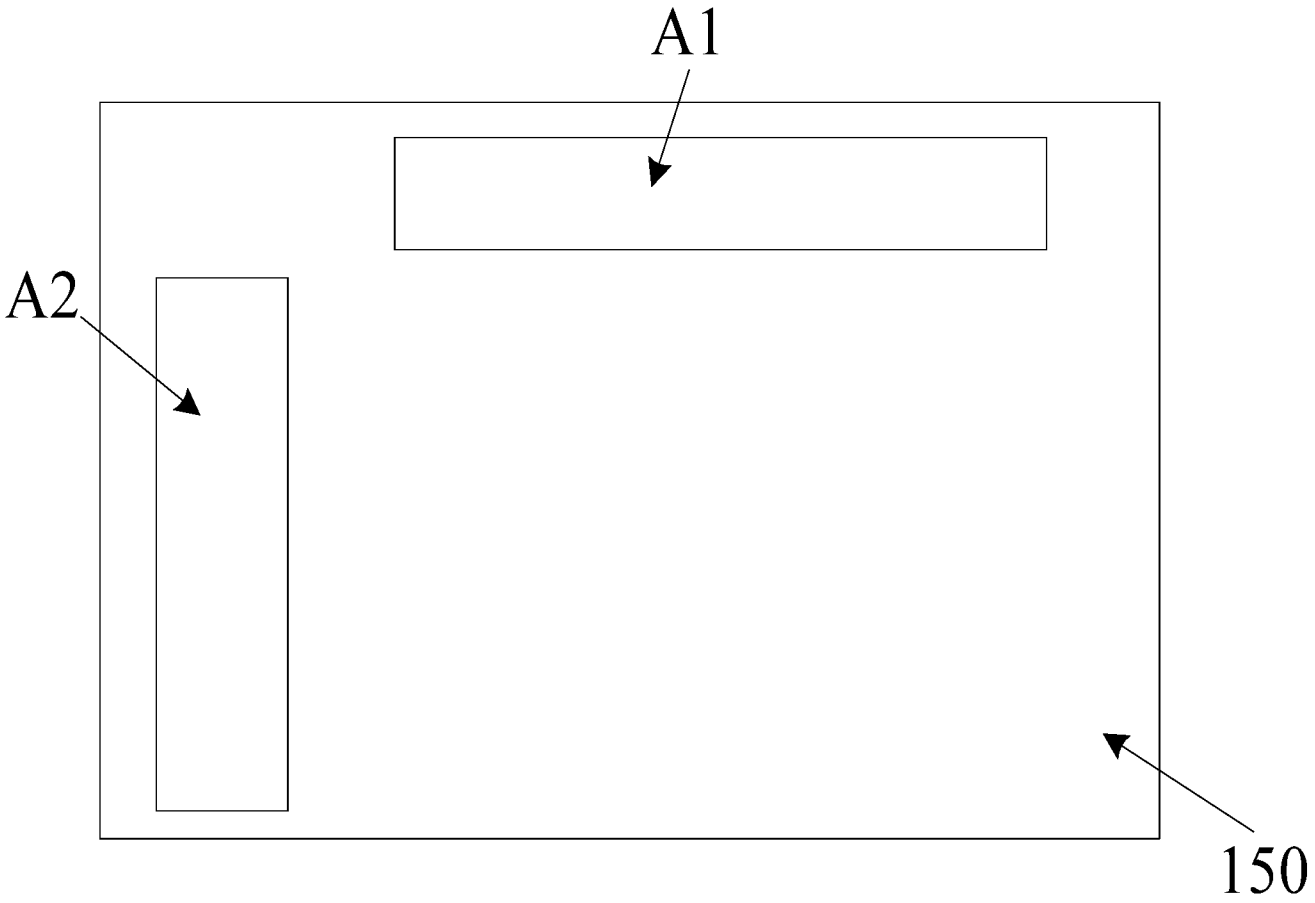
FIG. 17 is a top view of a detection device provided in an embodiment of the present disclosure.

Optionally, as shown in FIG. 17, FIG. 17 is a top view of a detection device provided in an embodiment of the present disclosure. The detection device may further comprise a bearing base 150, a first signal input component A1 and a second signal input component A2 that are connected to the processor.

Herein, the bear base is configured to bear a display panel; the first signal input component is configured to provide the data signal used for detection to data lines in the display panel under the control of the processor.

The second signal input component is configured to provide the gate electrode scan signal used for detection to gate lines in the display panel under the control of the processor.

Optionally, the first signal input component A1 and the second signal input component A2 are both arranged on the bearing base 150. When it is required to detect the display panel, the display panel may be arranged on the bearing base 150, and a plurality of data lines in the display panel are connected to the first signal input component A1; and a plurality of gate lines in the display panel are connected to the second signal input component A2. A connection relationship between the detection device and the display panel may refer to FIG. 3.

It should be noted that the processor in the detection device may be connected to the first signal input component A1 and the second signal input component A2; or the processor and the memory may be simultaneously arranged in each of the first signal input component A1 and the second signal input component A2. Thus, the first signal input component can input a first data signal to each of the plurality of data lines or can input a second data signal to each of the plurality of data lines; and the second signal input component can input a first gate electrode scan signal to each of the plurality of gate lines or input a second gate electrode scan signal to each of the plurality of gate lines.

In an exemplary embodiment, there is also provided a non-volatile computer-readable storage medium comprising instructions, such as a memory comprising the instructions executable by a processor in a detection device to perform the detection method for the display panel described in the above steps 101 to 103, or the detection method for the display panel described in the above steps 201 to 207, or the detection method for the display panel described in the above steps 301 to 306, or the detection method for the display panel described in the above steps 401 to 406, or the detection method for the display panel described in the above steps 501 to 503. For example, the non-volatile computer-readable storage medium may be an ROM, a random access memory (RAM), a CD-ROM, a magnetic tape, a floppy disk, an optical data storage device, or the like.

In an exemplary embodiment, there is also provided a computer program product in which instructions are stored. When the instructions are run on the computer, the computer can execute the detection method for the display panel described in the above steps 101 to 103, or the detection method for the display panel described in the above steps 201 to 207, or the detection method for the display panel described in the above steps 301 to 306, or the detection method for the display panel described in the above steps 401 to 406, or the detection method for the display panel described in the above steps 501 to 503.

In an exemplary embodiment, there is also provided a chip comprising a programmable logic circuit and/or program instructions. When running, the chip is configured to realize the detection method for the display panel described in the above steps 101 to 103, or the detection method for the display panel described in the above steps 201 to 207, or the detection method for the display panel described in the above steps 301 to 306, or the detection method for the display panel described in the above steps 401 to 406, or the detection method for the display panel described in the above steps 501 to 503.

Persons of ordinary skill in the art can understand that all or part of the steps described in the above embodiments can be completed through hardware, or through relevant hardware instructed by programs that may be stored in a non-transitory computer readable storage medium, such as read-only memory, disk or CD, etc.

The foregoing descriptions are only optional embodiments of the present disclosure, and are not intended to limit the present disclosure. Within the spirit and principles of the disclosure, any modifications, equivalent substitutions, improvements, etc., are within the protection scope of the appended claims of the present disclosure.

What is claimed is:

1. A detection method for a display panel, wherein the display panel comprises a plurality of data lines, a plurality of gate lines, and a plurality of pixel units enclosed by the plurality of data lines and the plurality of gate lines in an intersected manner; at least a part of the pixel units comprises a driving circuit and a pixel electrode that are connected with each other; the driving circuit is further connected to a data input end, a gate electrode scan input end and a power source end, respectively; and the method comprises:

providing a second data signal to the data input end, providing a second gate line scan signal to the gate electrode scan input end, and providing a power source signal to the power source end, wherein during a signal inputting process, the second data signal is at a first level, a level of the second gate line scan signal jumps from the first level to a second level, a level of the power source signal jumps from the first level to the second level, and the level of the second gate line scan signal jumps before the jumping of the level of the power source signal;

acquiring a second voltage of each pixel electrode; and determining a faulty gate line according to the second voltage.

2. The method of claim 1, further comprising:

determining a faulty data line; and determining a position of a defective point in the display panel according to the faulty gate line and the faulty data line.

3. The method of claim 2, wherein determining the faulty data line comprises:

providing a first data signal to the data input end, providing a first gate line scan signal to the gate electrode scan input end, and providing a power source signal to the power source end, wherein during the signal inputting process, the first gate line scan signal is at the first level, a level of the first data signal jumps from the first level to the second level, a level of the power source signal jumps from the first level to the second level, and the level of the first data signal jumps before the jumping of the level of the power source signal;

acquiring a first voltage of each pixel electrode; and determining the faulty data line according to the first voltage.

4. The method of claim 3, wherein determining the faulty data line according to the first voltage comprises:

judging whether the first voltage of each pixel electrode is within a first reference voltage range; and determining that the data line which transmits the first data signal to a first target pixel unit is faulty, wherein the first target pixel unit is a pixel unit in which the first voltage of the pixel electrode is within the first reference voltage range;

wherein a lower limit value in the first reference voltage range is greater than or equal to a voltage value when the power source signal is at the second level.

5. The method of claim 4, wherein after acquiring the first voltage of each pixel electrode, the method further comprises:

judging whether the first voltage of each pixel electrode is within a third reference voltage range; and determining that the data line which transmits the first data line to a third target pixel unit is not faulty, wherein the third target pixel unit is a pixel unit in which the first voltage of the pixel electrode is within the third reference voltage range, wherein a lower limit value in the third reference voltage range is greater than an upper limit value in the first reference voltage range.

6. The method of claim 3, wherein, when the first gate line scan signal is at the first level, the voltage value is 20 volts; when the first data signal is at the first level, the voltage value is 25 volts; when the first data signal is at the second level, the voltage value is −8 volts; when the power source signal is at the first level, the voltage value is 25 volts; and when the power source signal is at the second level, the voltage value is −15 volts; and when the second data signal is at the first level, the voltage value is 8 volts; when the second gate line scan signal is at the first level, the voltage value is 25 volts; and when the second gate line scan signal is at the second level, the voltage value is −25 volts.

7. A detection apparatus for a display panel, wherein the display panel comprises a plurality of data lines, a plurality of gate lines, and a plurality of pixel units enclosed by the plurality of data lines and the plurality of gate lines in an intersected manner; at least a part of the pixel units comprises a driving circuit and a pixel electrode that are connected with each other; the driving circuit is further connected to a data input end, a gate electrode scan input end and a power source end, respectively; and the apparatus comprises:

a second input module configured to provide a second data signal to the data input end, provide a second gate line scan signal to the gate electrode scan input end, and provide a power source signal to the power source end, wherein during a signal inputting process, the second data signal is at a first level, a level of the second gate line scan signal jumps from the first level to a second level, a level of the power source signal jumps from the first level to the second level, and the level of the second gate line scan signal jumps before the jumping of the level of the power source signal;

a second acquirement module configured to acquire a second voltage of each pixel electrode; and a second determination module configured to determine a faulty gate line according to the second voltage.

8. A detection device comprising:

a processor, and a memory storing at least one program executed by the processor for performing the detection method for the display panel according to claim 1.

9. The method of claim 1, wherein determining the faulty gate line according to the second voltage comprises:

judging whether the second voltage of each pixel electrode is within a second reference voltage range; and determining that the gate line which transmits the second gate line scan signal to a second target pixel unit is faulty, wherein the second target pixel unit is a pixel unit in which the second voltage of the pixel electrode is within the second reference voltage range;

wherein a lower limit value in the second reference voltage range is greater than or equal to a voltage value when the power source signal is at the second level.

10. The method of claim 9, wherein after acquiring the second voltage of each pixel electrode, the method further comprises:

judging whether the second voltage of the pixel electrode is within a fourth reference voltage range; and determining that the gate line which transmits the second gate line scan signal to a fourth target pixel unit is not faulty, wherein the fourth target pixel unit is a pixel unit in which the second voltage of the pixel electrode is within the fourth reference voltage range;

wherein a lower limit value in the fourth reference voltage range is greater than an upper limit value in the second reference voltage range.

11. The method of claim 2, wherein an occurrence of the defective point in the display panel refers to when the gate line and the data line in the display panel are short-circuited.

12. A detection method for a display panel, wherein the display panel comprises a plurality of data lines, a plurality of gate lines, and a plurality of pixel units enclosed by the plurality of data lines and the plurality of gate lines in an intersected manner; at least a part of the pixel units comprises a driving circuit and a pixel electrode that are connected with each other; the driving circuit is further connected to a data input end, a gate electrode scan input end and a power source end, respectively; and the method comprises:

providing a first data signal to the data input end, providing a first gate line scan signal to the gate electrode scan input end, and providing a power source signal to the power source end, wherein during a signal inputting process, the first gate line scan signal is at a first level, a level of the first data signal jumps from the first level to a second level, a level of the power source signal jumps from the first level to the second level, and the level of the first data signal jumps before the jumping of the level of the power source signal;

acquiring a first voltage of each pixel electrode; and determining a faulty data line according to the first voltage.

13. The method of claim 12, wherein determining the faulty data line according to the first voltage comprises:

judging whether the first voltage of each pixel electrode is within a first reference voltage range; and determining that the data line which transmits the first data signal to a first target pixel unit is faulty, wherein the first target pixel unit is a pixel unit in which the first voltage of the pixel electrode is within the first reference voltage range;

wherein a lower limit value in the first reference voltage range is greater than or equal to a voltage value when the power source signal is at the second level.

14. The method of claim 13, wherein after acquiring the first voltage of each pixel electrode, the method further comprises:

judging whether the first voltage of each pixel electrode is within a third reference voltage range; and determining that the data line which transmits the first data signal to a third target pixel unit is not faulty, wherein the third target pixel unit is a pixel unit in which the first voltage of the pixel electrode is within the third reference voltage range;

wherein a lower limit value in the third reference voltage range is greater than an upper limit value in the first reference voltage range.

15. The method of claim 12, further comprising:

determining a faulty data line; and determining a position of a defective point in the display panel according to the faulty gate line and the faulty data line.

16. The apparatus of claim 7, wherein the second determination module is configured to:

judge whether the second voltage of each pixel electrode is within a second reference voltage range; and determine that the gate line which transmits the second gate line scan signal to a second target pixel unit is faulty, wherein the second target pixel unit is a pixel unit in which the second voltage of the pixel electrode is within the second reference voltage range;

wherein a lower limit value in the second reference voltage range is greater than or equal to a voltage value when the power source signal is at the second level.

17. The apparatus of claim 16, further comprising:

a second judgement module configured to judge whether the second voltage of each pixel electrode is within a fourth reference voltage range; and a fifth determination module configured to determine that the gate line which transmits the second gate line scan signal to a fourth target pixel unit is not faulty, wherein the fourth target pixel unit is a pixel unit in which the second voltage of the pixel electrode is within the fourth reference voltage range;

wherein a lower limit value in the fourth reference voltage range is greater than an upper limit value in the second reference voltage range.

18. The detection device of claim 8, further comprising: a bearing base, a first signal input component and a second signal input component that are connected with the processor;

wherein the bear base is configured to bear a display panel;

the first signal input component is configured to provide the data signal used for detection to data lines in the display panel under the control of the processor, and the second signal input component is configured to provide the gate electrode scan signal used for detection to gate lines in the display panel under the control of the processor.

19. The detection device of claim 18, wherein the first signal input component and the second signal input component are arranged on the bear base.

20. A detection device comprising:

a processor, and a memory storing at least one program executed by the processor for performing the detection method for the display panel according to claim 12.

* * * * *